US009157180B2

(12) United States Patent
Hu

(10) Patent No.: US 9,157,180 B2
(45) Date of Patent: Oct. 13, 2015

(54) DRYING-IRONING COMBINED MACHINE

(76) Inventor: Jiebo Hu, Zhejiang (CN)

( * ) Notice: Subject to any disclaimer, the term of this patent is extended or adjusted under 35 U.S.C. 154(b) by 36 days.

(21) Appl. No.: 14/008,318

(22) PCT Filed: Dec. 1, 2011

(86) PCT No.: PCT/CN2011/002011

§ 371 (c)(1),
(2), (4) Date: Nov. 27, 2013

(87) PCT Pub. No.: WO2012/129750

PCT Pub. Date: Oct. 4, 2012

(65) Prior Publication Data

US 2014/0082978 A1 Mar. 27, 2014

(30) Foreign Application Priority Data

Mar. 28, 2011 (CN) ..... 2011 1 0082754
May 21, 2011 (CN) ..... 2011 1 0147430

(51) Int. Cl.

| | |
|---|---|
| ***D06F 87/00*** | (2006.01) |
| ***D06F 75/06*** | (2006.01) |
| ***D06F 73/00*** | (2006.01) |
| ***D06F 67/00*** | (2006.01) |
| ***D06F 58/14*** | (2006.01) |

(52) U.S. Cl.

CPC ..... *D06F 67/005* (2013.01); *D06F 58/14* (2013.01); *D06F 73/00* (2013.01); *D06F 75/06* (2013.01); *D06F 87/00* (2013.01)

(58) Field of Classification Search

CPC ..... D05C 7/00; D05C 2700/13; D06F 75/06; D06F 75/30; D06F 87/00; D06F 73/00; D06F 58/10; D06F 58/14

USPC ..... 223/52, 70, 67; 68/222; 34/201, 202; 38/2, 75, 77.83, 82, 85, 88

See application file for complete search history.

(56) References Cited

U.S. PATENT DOCUMENTS 3,333,747 A * 8/1967 Glover, Jr. ..... 223/70
4,875,301 A * 10/1989 Adams ..... 38/14

(Continued)

FOREIGN PATENT DOCUMENTS

CN 2903148 Y 5/2007
CN 101178910 A 5/2008

(Continued)

*Primary Examiner* — Ismael Izaguirre
(74) *Attorney, Agent, or Firm* — Cesari and McKenna, LLP

(57) ABSTRACT

A drying-ironing combined machine. The machine includes a supporting body (1), a pillar (4) located on the supporting body (1), a drying unit (2) and an ironing unit (3). The drying unit (2) comprises a drying rack member (21), a hood (22) supporting body on the drying rack member (21), and a heating member (23). A venting port (232) of the heating member (23) is in a sealed communication with an air inlet (225) of the hood (22). The drying unit (2) has a clothes drying region formed on one side of the pillar (4). The ironing unit (3) comprises an ironing device and a clothes hanger (331). The ironing unit (3) has an ironing region formed on the other side of the pillar (4). The drying-ironing combined machine allows for drying and ironing of clothes to be performed simultaneously without interference with each other, thus improving the capability of the machine in handling dry and wet clothes, increasing convenience of use, reducing operational difficulty during use, preventing energy wastage, allowing for a reduced footprint, and being particularly applicable in use in room having limited space.

46 Claims, 32 Drawing Sheets

(56) References Cited

U.S. PATENT DOCUMENTS

| | | | | |
|---|---|---|---|---|
| 5,609,047 | A * | 3/1997 | Hellman et al. | 68/222 |
| 6,295,691 | B1 * | 10/2001 | Chen | 15/321 |
| 6,910,291 | B2 * | 6/2005 | Schwass | 38/14 |
| 7,475,504 | B2 * | 1/2009 | Leung | 38/75 |
| 7,603,801 | B2 * | 10/2009 | Jiang et al. | 38/104 |
| 2004/0163184 | A1 * | 8/2004 | Waldron et al. | 8/149.1 |
| 2007/0151309 | A1 * | 7/2007 | Kendall et al. | 68/235 R |
| 2008/0222909 | A1 * | 9/2008 | Picozza et al. | 34/195 |
| 2013/0263465 | A1 * | 10/2013 | Hu | 34/202 |

FOREIGN PATENT DOCUMENTS

| | | | |
|---|---|---|---|
| CN | 101603264 | B | 7/2011 |
| CN | 102199866 | B | 7/2012 |
| JP | 2006-296801 | A | 11/2006 |

* cited by examiner

DRYING-IRONING COMBINED MACHINE

CROSS REFERENCE TO RELATED APPLICATIONS

This application is the national stage entry under 35 USC 371 for PCT/CN2011/002011, filed on Dec. 1, 2011, which claims the benefit of the Mar. 28, 2011 priority date of Chinese Application No. 201110082754.2 and the May 21, 2011 priority date of Chinese Application No. 201110147430.2. The contents of the foregoing applications are incorporated herein by reference.

BACKGROUND OF THE INVENTION

1. Field of the Invention

The present invention relates to a clothing treatment apparatus, and in particular, to a household drying-ironing combined machine.

2. Description of the Related Art

Nowadays there are several kinds of portable drying machines in the household electrical appliance market. For example, the prior art reference 1 (Chinese Patent: CN2567261Y) discloses a "clothes dryer". The clothes dryer comprises a warm air blower and a supporting rod provided on the warm air blower and an intake opening formed on the bottom of the warm fan. A fan is disposed above the intake opening within the warm air blower. A venting opening is formed, corresponding to the exit end of the fan, at the upper part of the warm air blower. A heater is provided in an air duct between the fan and the venting port. Air flow from the warm air blower spreads out upwardly through the venting port. The hot air flow may blow into these clothes placed above the warm air blower. However, such clothes dryer only has a clothes drying function by application of the hot air flow, and no clothes ironing function. Further, this dryer has a relatively large volume, and it is difficult to be stored when not in use.

Another prior art reference 2 (United States Patent: US20040144140A1) discloses a "steam apparatus". This steam apparatus comprises a steam engine and a body. At the head of the body is provided a distributor for discharge of the steam. The body also comprises a bracket for hanging of the clothes. In this steam apparatus, clothes ironing may be performed when the clothes is hung on the bracket. However, similar to that of the prior art reference 1, the steam apparatus in the prior art reference 2 has only clothes ironing function but no clothes drying function. Accordingly, this steam apparatus cannot achieve the ironing function and the drying function at the same time.

Bearing in mind of the above prior arts, some examples of a multi-functional clothes treatment apparatus for performing the clothes ironing and clothes drying simultaneously are developed. For example, the prior art reference 3 (Chinese Patent: CN2903148Y) discloses a "steam ironing and drying machine", and, the prior art reference 4 (Chinese Patent: CN101603264A) discloses a "steam brush with clothes drying function". Both the prior art references 3 and 4 relate to the drying-ironing combined electrical appliance which adopts the arrangement that the functional elements in a clothes dryer and those in a steam ironer are combined together so as to achieve both of the abovementioned functions.

In the prior art reference 3, a clothes drying bracket is disposed over an air heater. Venting opening is annually arranged on the air heater around the connection between the clothes drying bracket and the air heater. A cylindrical hood is further provided by covering the drying bracket from the top and closed sealedly below the venting opening such that it contains the drying bracket and the venting opening within an accommodation space thereof. This arrangement can be used to perform the clothes ironing and clothes drying simultaneously. However, since it is not covered by the hood when performing the ironing, the hot air flow from the air heater will easily disperse to the ambient environments such that the hot air flow cannot be sufficiently utilized. Accordingly, it has disadvantages such as reduced utilization ratio of the hot air flow, prolonged drying time, increased electrical energy consumption, and low work efficiency.

In the prior art reference 4, a hot air flow diffusion hood has its lower end connected to a housing and has its central top end connected to a clothes hanger. Venting opening is provided at the periphery of the top end. An enclosure is provided around the clothes hanger. The hot air flow diffusion hood is located at the bottom of the enclosure and has an outflow opening at the top thereof. Since the whole clothes hanger is enclosed in the hood, little of the hot air flow will disperse. As to the clothes drying, it is only required to hang the clothes on the clothes through a pick-and-place door. Accordingly, for the clothes drying, it has advantages such as low electrical energy consumption, shortened drying time, and high work efficiency. However, for the clothes ironing, the steam sprayer, which is used to perform the ironing, must go through the door of the hood and into the inside of the hood if the hood has not been removed. Since use of the steam sprayer is restricted due to existence of the door, it is not easy to perform the ironing quickly. Once the clothes ironing and the clothes drying are performed simultaneously, the door should be kept in an opened state, and so, the hot air flow within the hood will continuously disperse to the outside through the door and water vapor from the ironing member will run towards the hood, thereby resulting in prolonging of drying time and waste of electrical energy.

If the hood has been removed before the ironing workings, the clothes would be ironed by directly hanging it onto the clothes rack. In this way, the disadvantages brought by inconvenient operations of the ironing are avoided. However, removal of the hood gives rise to additional burden as the clothes hanger is used both during the clothes ironing and during the clothes drying. In the process of clothes drying, the clothes hanger is required to be covered with the hood. In the process of clothes ironing, the hood should be removed. And, in the next clothes drying, the clothes hanger needs to be covered with the hood. Repeated assemble and removal of the hood turn out to be troublesome, labor-intensive and inefficient. Further, the clothes ironing and the clothes drying are not performed simultaneously. Accordingly, the conventional drying-ironing combined machine neither perform the clothes ironing and the clothes drying simultaneously nor operate the clothes ironing in an open environment. In fact, the conventional machine performs the clothes ironing and the clothes drying alternatively, which leads to inefficiency and labor-intensiveness.

Moreover, in the arrangements both in the prior art references 3 and 4, the control panel is provided at the housing of the machine, and, the cylindrical hood is over the clothes hanger and ends up at connection between a wind shed and the housing. As size of the bottom of the cylindrical hood is greater than that of the housing, the cylindrical hood would just cover over the whole housing when in an unfolded and inflated state. When in use, in order to know current status of the drying operation shown on the control panel, the operator has to squat so as to observe the control panel and operate, because it is hard to observe the control panel when the operator stands 1.5 meters away around the hood. Theoretically, it is difficult for the operator to see clearly those parameters shown on the control panel when he/she is away at a distance of 1.5 meter or more, due to limited range of vision. Actually, in practice, the operator firstly has a vague idea where the control panel is located when he/she is away at a distance 1.5 meter or more, and then, gets closer to operate the control panel.

Obviously, this brings great inconvenience to the operators. In order to solve this problem, the person skilled in the art adopts a larger housing in which the control panel is positioned at a more outward location, however, this solution requires a bulky volume and increases the cost. That is, there is still no ideal solution which takes accounts of both the manufacturer's gain and the operator's benefit.

In addition, since the supporting pillar is located inside the hood in the prior art, the hot air flow in the hood would be delivered directly to the pillar to cause the pillar to be overheated, thereby resulting in hidden trouble and potential safety problem of the machine.

SUMMARY OF THE INVENTION

The technical solution to be solved in the present invention is to provide a drying-ironing combined machine, which is capable of performing the clothes ironing and the clothes drying simultaneously and is safety in operations and has high efficiency.

In order to solve the above-mentioned technical problems, according to an aspect of the present invention, a technical solution is provided as follows.

A drying-ironing combined machine comprises a supporting body, and a pillar uprightly located above the supporting body, and a drying unit as well as an ironing unit.

The drying unit comprises a drying rack member mounted on an upper end of the pillar and located in a deploying manner at one side of the pillar, a hood supported on the drying rack member and located in a naturally hanging-down manner at one side of the pillar to form an accommodation space, and a heating member for supplying a heated air into the accommodation space of the hood, wherein, the hood has an air inlet and an air outlet thereon, the heating member has a venting port being hermetically intercommunicated with the air inlet of the hood, and, the drying unit has a clothes drying region formed at one side of the pillar.

The ironing unit comprises a clothes hanger mounted on the upper end at the other side of the pillar, a steam generator located within the supporting body, and, a steam outlet port provided on a housing of the supporting body and hermetically connected to the steam generator, wherein a steam hose has one end connected to the steam outlet port and the other end connected to a steam sprayer, and, the ironing unit has a clothes ironing region formed at another side of the pillar.

According to another aspect of the present invention, a drying-ironing combined machine, comprises a supporting body, and a pillar uprightly located above the supporting body, and a drying unit as well as an ironing unit.

The drying unit is located at one side of the pillar, the drying unit comprises a drying rack member located on an upper end, and at one side, of the pillar, a hood supported on the drying rack member and located in a naturally hanging-down manner along the pillar, and a heating member for supplying a heated air into an accommodation space of the hood, wherein the hood has an air outlet and an air inlet thereon, the heating member comprises a venting port deviated from the pillar and hermetically connected to the air inlet of the hood.

The ironing unit is located at the other side of the pillar, the ironing unit comprises a clothes hanger mounted on the upper end at the other side, of the pillar, a steam generator located within the supporting body, a steam outlet port provided on a housing of the supporting body which is located at the other side of the pillar, and hermetically connected to the steam generator, wherein a steam hose has one end connected to the steam outlet port and the other end connected to a steam sprayer.

Preferably, the heating member is located within the supporting body, the housing of the supporting body is provided with intake openings and said venting ports thereon, in the supporting body is provided an air flow passageway between the intake openings and the venting ports, and the heating member comprises a fan and a heating element located in the air flow passageway.

In order to allow the heated air from the heating member to come towards the hood after being cooled down, a chamber is provided between the venting port of the heating member and the air inlet at the bottom of the hood and a top plate of which is mated with the air inlet of the hood, and, wherein several venting holes which go through the hood are provided on the top plate.

As an alternative example, a chamber that is connected to the air inlet of the hood is provided between the hood and the supporting body, wherein the chamber is intercommunicated with intake holes and has a partition by which the chamber is divided into an upper buffer room and a lower electrical appliances room being intercommunicated with each other, and, the heating member is mounted on the partition.

Preferably, the intake holes are located on a side wall of the chamber; or, said chamber is intercommunicated with the supporting body, and, the intake holes are located on the supporting body.

As another alternative example, the heating member is mounted, on the pillar above the drying rack member, on the middle part of the pillar between the drying rack member and the supporting body, or, on a lower end of the pillar.

In order to allow the heated air from the heating member to come towards the hood after cooled down, in the state that the heating member is mounted on the pillar that is above the drying rack member, within a housing of the heating member is provided a partition by which the housing of the heating member is divided into an upper electrical appliances room and a lower buffer room, a fan and a heating element of the heating member are coaxially mounted on the partition toward the electrical appliances room, at an upper end of the housing of the heating member is provided the intake openings, and, a plurality of venting holes is distributed on a bottom plate of the housing of the heating member and is in communication with an upper opening, i.e., the air inlet, of the hood.

Alternatively, in the state that the heating member is mounted on a lower end of the pillar, a plurality of venting holes is provided on a top plate of the housing of the heating member and is in communication with a lower opening, i.e., the air inlet, of the hood, at a bottom end of the housing of the heating member is provided a plurality of intake openings, within a housing of the heating member is provided a partition by which the housing is divided into a lower electrical appliances room and an upper buffer room, a fan and a heating element of the heating member are coaxially mounted on the partition toward the electrical appliances room.

In order to sufficiently deploy and secure the top of the hood in a better manner, the drying rack member comprises a top supporting frame and a lateral buckle device located on the top supporting frame. Top end of the hood is mounted on the top supporting frame and is also mounted on the upper end of the pillar by means of the lateral buckle device.

In order to allow volume of the hood to be reasonably compact, the top supporting frame is in an elliptic shape, and has an accommodation width corresponding to a shoulder width of the tops and an accommodation thickness corresponding to a chest and back thickness of the tops, and, the lateral buckle device is located in the middle along the direction of the accommodation width of the top supporting frame.

In order to achieve a better connection between the heat member and the hood, the drying rack member comprises the top supporting frame mounted in an annular recess around the bottom of the housing of the heating member.

In order to facilitate hanging of the dried clothes in the hood, the lateral buckle device includes a hanger extending towards the hood.

In order to sufficiently deploy and secure the bottom of the hood in a better manner, a bottom frame or a bottom plate is provided at the bottom of the hood and is mounted on a lower end of the pillar by a lateral buckle.

In order to facilitate placement of the steam sprayer, the ironing unit further comprises a retaining shelf adapted for placement of the steam sprayer and located at an upper part of the clothes hanger.

Preferably, the pillar comprises first and second supporting rods horizontally spaced by a distance and being parallel to each other so as to be arranged in a "||" configuration, and, the drying rack member is located on the second supporting rod and the clothes hanger is located on the first supporting rod.

Alternatively, the pillar comprises first and second supporting rods which have upper parts thereof horizontally spaced by a distance and lower parts combined together so as to be arranged whole in a substantially "Y" configuration, and, the drying rack member is located on the second supporting rod and the clothes hanger is located on the first supporting rod.

In order to achieve a more stable configuration of the pillar, the pillar comprises first and second supporting rods which have lower parts thereof horizontally spaced by a distance and upper parts connected with each other so as to be generally arranged in a "n" configuration, and, the drying rack member is located on the second supporting rod and the clothes hanger is located on the first supporting rod.

In order to prevent shaking of the hood relative to the pillar, the hood, on the back surface thereof, has a lower perforated hole and an upper perforated hole through which certain section of the pillar passes, and the certain section of the pillar is located inside the hood.

In order to facilitate hanging of the clothes within the hood, the certain section of the pillar inside the hood is provided with at least one hanger.

In order to facilitate hanging of the dried clothes, the pillar comprises a first extension arm provided at a top end thereof and protruding towards the drying unit, wherein the first extension arm has a plurality of hookers thereon, and, wherein the hood has an opening at the top thereof and from which the clothes are hung onto the hooker, wherein the opening serves as the air outlet.

In order to facilitate hanging of a number of ironed clothes, the pillar comprises a second extension arm provided at the top end thereof and protruding towards the ironing unit and being integrated with the first extension arm, and, wherein the second extension arm also has a plurality of hookers thereon.

As a further alternative example, in order that the hood has a free and independent configuration, the hood has a stretching mechanism at the top thereof, and, wherein the stretching mechanism comprises a clothes hanging arrangement for hanging of the hood on the first extension arm and a discoid arrangement for the stretching of an upper end of the hood.

In order to maintain the relative arrangement between the hood and the pillar, the hood, on the back surface thereof, has fastening mechanism by which the hood is fastened onto the pillar.

In order to pack up the hood, it further comprises a binding member for gathering and fastening the hood onto the pillar.

Compared with the prior art, the present invention at least has following advantages.

First, the pillar is flanked by the hood of the drying unit and the ironing unit, and, the clothes drying region and the clothes ironing region are in either side of the pillar. That is, the clothes drying region and the clothes ironing region are separated by the pillar. In this way, the ironing operation on the clothes hung over the clothes hanger is performed in the clothes ironing region and is kept away from the hood, so that the ironing operation can be performed in an open and independent ironing environment. Meanwhile, it does not impact on the drying operation in the hood and thus an independent drying environment without interference by water steam is achieved. Accordingly, the present invention can perform the clothes ironing and the clothes drying simultaneously, without interference between each other. Therefore, the machine improves the performance for handling both dry clothes and wet clothes, facilitates the use, reduces the operation difficulty, eliminates possible waste of electrical energy, and takes up less space occupied, and is particularly suitable to be applied in a room where space is limited.

Second, because the pillar is flanked by the hood of the drying unit and the ironing unit, the machine entirely is balanced in weight and has a stable configuration. Moreover, because the venting port of the heating member is provided at one side of the pillar and tight connection from the venting port to the air inlet of the hood is spaced from the pillar, the heated air flow from the heating member is prevented to be delivered directly to the pillar, so as to eliminate hidden trouble when the pillar is heated and provide a safety environment for the clothes drying.

Third, because the pillar does not occupy the space inside the hood, it facilitates pick-and-place of the clothes and smoothes the flowing of the heated air flow, so as to enhance efficiency of clothes drying.

Fourth, since the hood is located at one side of the pillar, it would not affect operations within the region at the other side of the pillar. Thus, a control panel can be provided at the supporting body against the other side, which facilitates the operator to observe and operate. In this way, the traditional operating manner that the operator should stay at a short distance and squat to observe and operate control panel, in which the control panel is obstructed due to provision of the hood over the whole pillar and the wind shed and that the upper part of the whole supporting body is covered over with the skirt part of the hood, is improved.

Fifth, the wind shed included in the conventional configuration is removed such that problem that low stability and mechanical strength caused by superimposition of the pillar, the wind shed and the supporting body is solved. And in the present invention, the pillar is secured directly to the supporting body, which brings enhanced mechanical strength and safety performance and thus the machine achieves better stability when loaded.

Sixth, because the pillar does not occupy the space inside the hood, it facilitates, the hood may be designed to have an accommodation width that corresponds to a shoulder width of at least one of the tops and an accommodation thickness that corresponds to a chest and back thickness of at least one of the tops. Accordingly, the prevent invention provides an accommodation space which owns the suitable sizes for drying the tops and the pillar may be arranged in the top supporting frame, at the middle in the width direction thereof. In this way, the machine achieves a smart configuration and is balanced in weight. Accordingly, the prevent invention provides an accommodation space in which one or two pieces of clothes may be accommodated for drying. In this way, it achieves quick drying of the clothes and energy savings.

BRIEF DESCRIPTION OF THE DRAWINGS

FIGS. 30*a* to 30*f* are schematic views according to a thirteenth embodiment of the present invention, in which FIG. 30*a* shows a heating element located on the top of an upright pillar, FIG. 30*b* shows a heating element mounted above an upright pillar, FIG. 30*c* shows a heating element fixedly located on a top supporting body frame above an upright pillar, FIG. 30*d* shows a heating element located in the middle of an upright pillar, FIG. 30*e* shows a heating element fixedly located on a below an upright pillar, and, FIG. 30*f* shows a heating element fixedly located on a base plate at the bottom of an upright pillar.

FIGS. 34*a* to 34*d* are flowchart diagrams for these operational modes, in which FIG. 34*a* is a flowchart diagram for a first operational mode, FIG. 34*b* is a flowchart diagram for a second operational mode, FIG. 34*c* is a flowchart diagram for a third operational mode, and, FIG. 34*d* is a flowchart diagram for a fourth operational mode.

DETAILED DESCRIPTION OF EMBODIMENTS OF THE INVENTION

Figure 1:
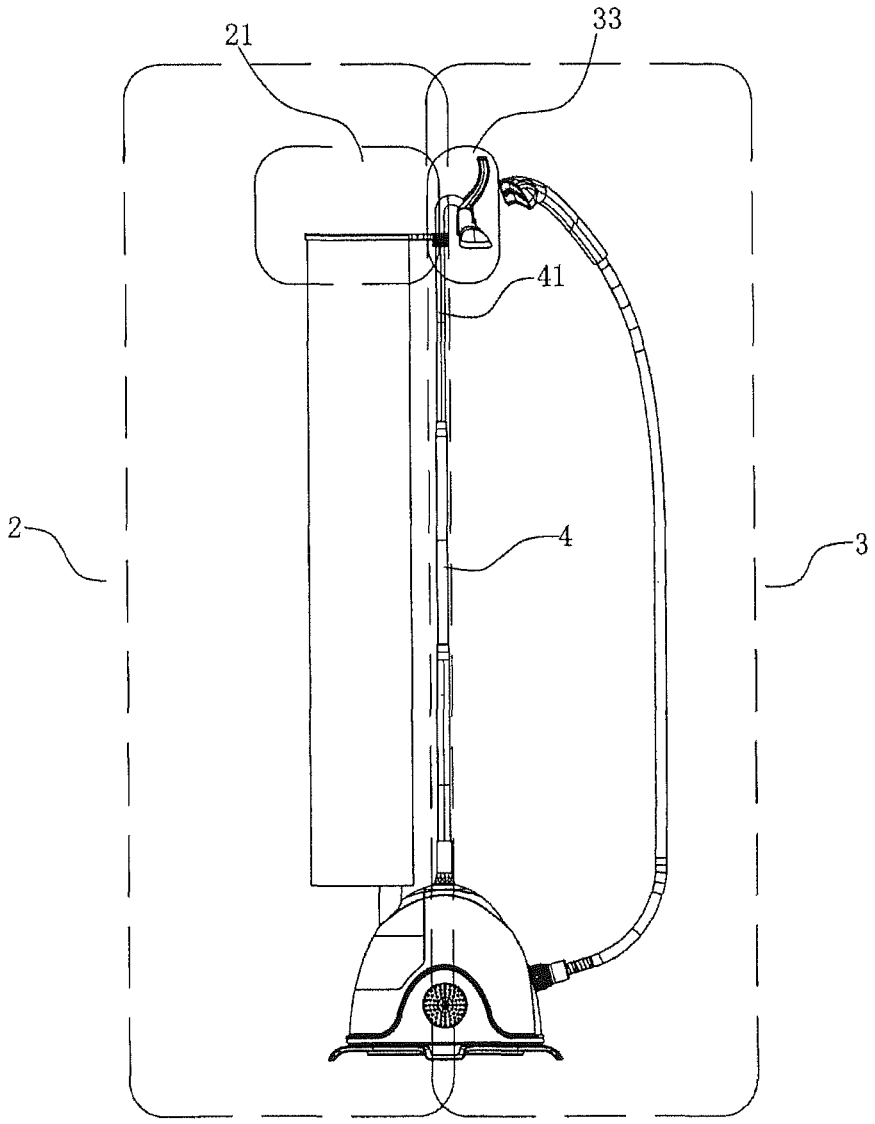
FIG. 1 is a side view of a drying-ironing combined machine according to a first embodiment of the present invention.

Exemplary embodiments of the present disclosure will be described hereinafter in detail with reference to the attached drawings.

First Embodiment

As shown in FIGS. 1-5, a drying-ironing combined machine is provided. The drying-ironing combined machine comprises a supporting body 1 and a pillar 4 of which a lower end is mounted to the supporting body 1. A drying unit 2 comprises a drying rack member 21 located at left side of the pillar 4 and mounted at an upper end 41 of the pillar; a hood 22, at its upper end, hung over the drying rack member 21, the hood 22 being in a naturally hanging-down manner at the left side of the pillar 4; and, a heating member 23 provided inside the supporting body 1. At a housing of the supporting body 1, there provides a control panel 12 for controlling the operation of the machine, a power cord 14 for connection with exterior power supply, and, an intake opening 231 and a venting port 232 for the heating member 23. Within the supporting body 1, there provides an air flow passageway 239 that communicates the intake opening 231 with the venting port 232. The heating member 23 includes a fan 238 and a heating element 237 located within the air flow passageway 239. In this embodiment, the venting port 232 is located at the housing of the supporting body at the left side of the pillar, that is, it deviates from the pillar. Meanwhile, for control and observation purposes, the control panel is provided at the housing of the supporting body 1 at the right side of the pillar.

Figure 4:
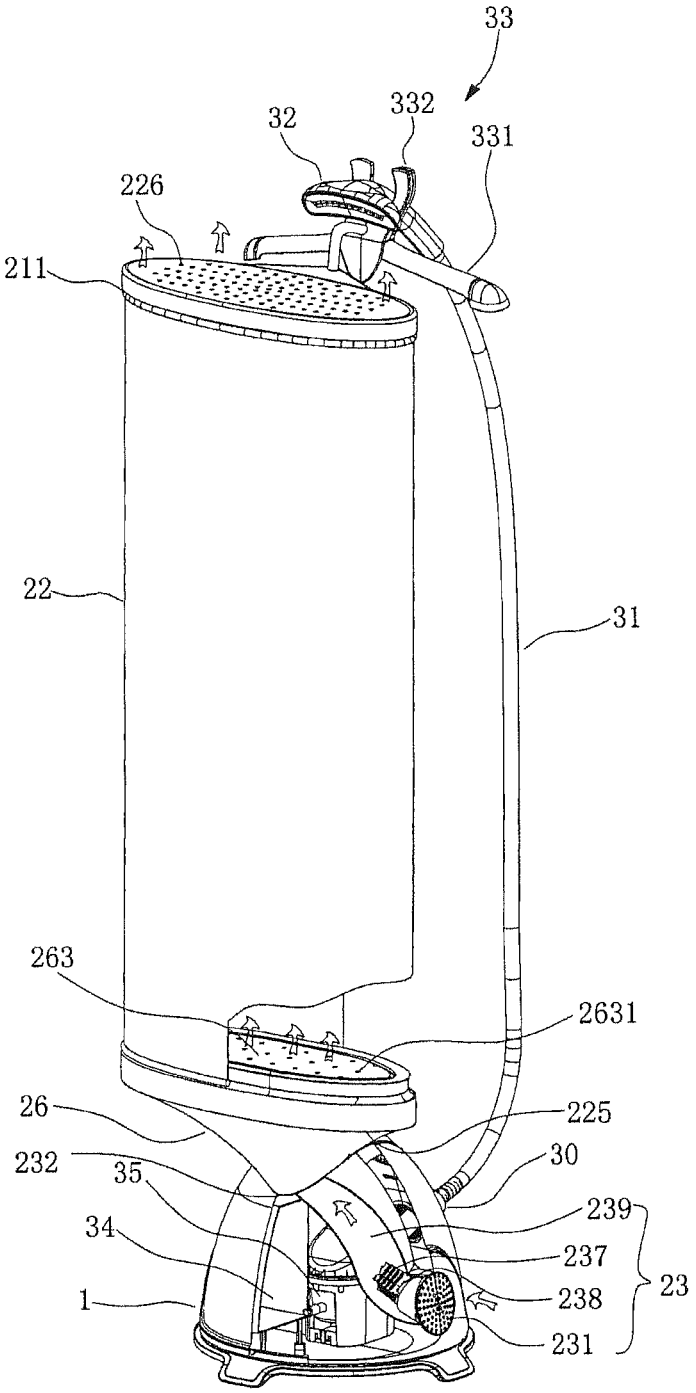
FIG. 4 is a sectional view of a supporting body of a drying-ironing combined machine according to a first embodiment of the present invention.

As shown in FIG. 4, the ironing unit 3 comprises a clothes hanger 331 mounted on the upper end at right side of the pillar 4, a water tank 34 and a steam generator 35 disposed within the supporting body 1, and, a steam outlet port 30 provided at right side of the housing of the supporting body 1 and hermetically connected to the steam generator 35. A steam hose 31 has one end hermetically connected to the steam outlet port 30 and the other end hermetically connected to a steam sprayer 32.

A fixation part 13 for the pillar 4 is provided at the housing of the supporting body 1, at a location which is away from the venting port 232 and the steam outlet port 30 by certain horizontal distance. The lower end of the pillar 4 is mounted on the fixation part 13. The upper end 41 of the pillar 4 is mounted with the drying rack member 21 at its left side and with an ironing member 33 at its right side. The drying rack member 21 comprises a top supporting frame 211. The hood 22 has its upper end hung over the top supporting frame 211 and is in a naturally hanging-down manner along the top supporting frame 211 at the left side of the pillar 4. The hood has a back surface 222 adjacent to the pillar 4 and a front surface 222 opposed to the back surface. An accommodation space 223 for drying the clothes therein is formed, between the back surface 221 and front surface 222, in the hood 22. A clothes pick-and-place door 224 is formed on the front surface 222 of the hood. The hood 22 has, at its upper part, an air outlet 226 and, at its lower part, an air inlet 225. The air inlet 225 at the lower part of the hood is hermetically connected to the venting port 232 of the heating member 23. The air flow heated by the heating member 23 flows into the accommodation space 223 via the air flow passageway 239 in order to dry the clothes in the accommodation space 223, and the created water vapor goes through the air outlet 226 at the upper part of the hood and discharges to the environment. The ironing member 33 located at the upper end but the right side of the pillar 4 comprises the clothes hanger 331 and a retaining shelf 332 positioned above the clothes hanger 331. The retaining shelf 332 is used for holding the steam sprayer 32. The clothes to be ironed will be hung on the clothes hanger 331 and, is ironed after it is taken from the steam sprayer 32. After being ironed with the steam vapor, the clothes will absorb the steam vapor and thus gets high dampness. At this moment, instead of being collected or dressed at once, the clothes should be easily moved into the drying unit 2 in order for drying operation. In this way, dampness of the clothes will be lowered to a suitable extent so that the clothes can be collected or dressed. Accordingly, the drying-ironing combined machine according to the present invention can be willfully switched over between the ironing operation and the drying operation, so that the clothes will have good flatness and material integrality.

Obviously, in this embodiment, a clothes drying region A is provided at the left side of the pillar 4 where the hood 22 is disposed. Oppositely, a clothes drying region B is provided at the right side of the pillar 4. Since the clothes drying region A and the clothes ironing region B are provided at either side of the pillar 4, respectively, clothes drying operation is performed by the drying unit 2 in the clothes drying region A while clothes ironing operation is performed by the ironing unit 2 in the clothes ironing region B. The two operations are independent of each other and one does not occupy the other's region. Interference from the hood 22 may be avoided during the ironing. Thus, the present invention provides an opening and independent circumstance for ironing operation. Meanwhile, the clothes drying operation will be performed within the hood 22 and effect of the simultaneously proceeding ironing operation can be avoided. Thus, the present invention provides an open and independent circumstance, without being blended with water vapour, for drying operation.

Figure 2:
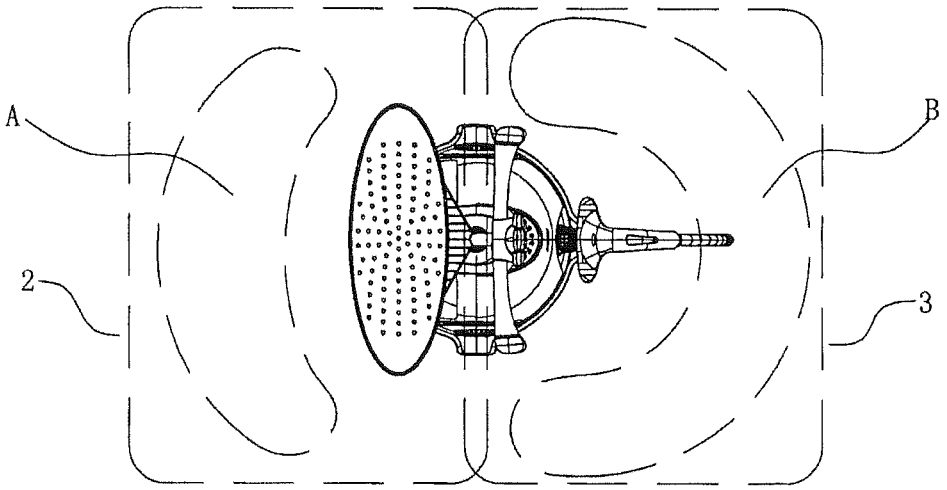
FIG. 2 is a top view of a drying-ironing combined machine according to a first embodiment of the present invention.
Figure 3:
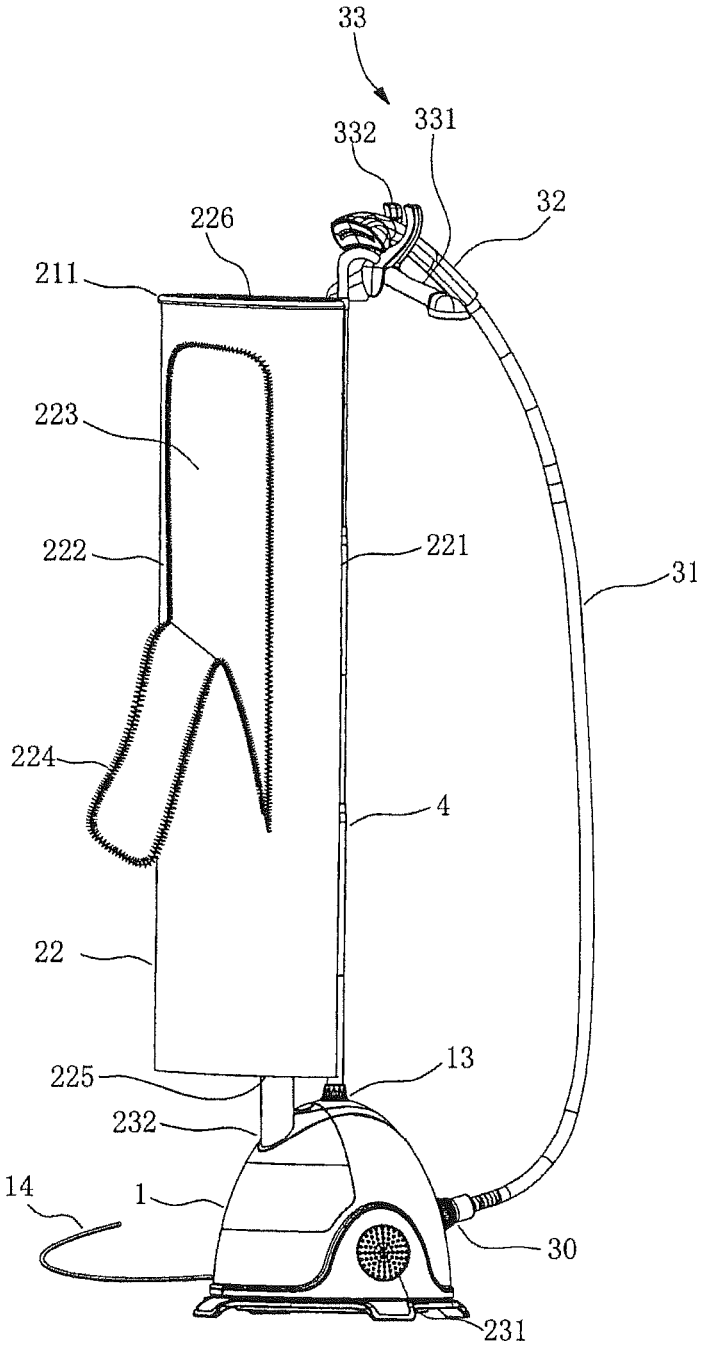
FIG. 3 is a schematically perspective view of a drying-ironing combined machine according to a first embodiment of the present invention.
Figure 5:
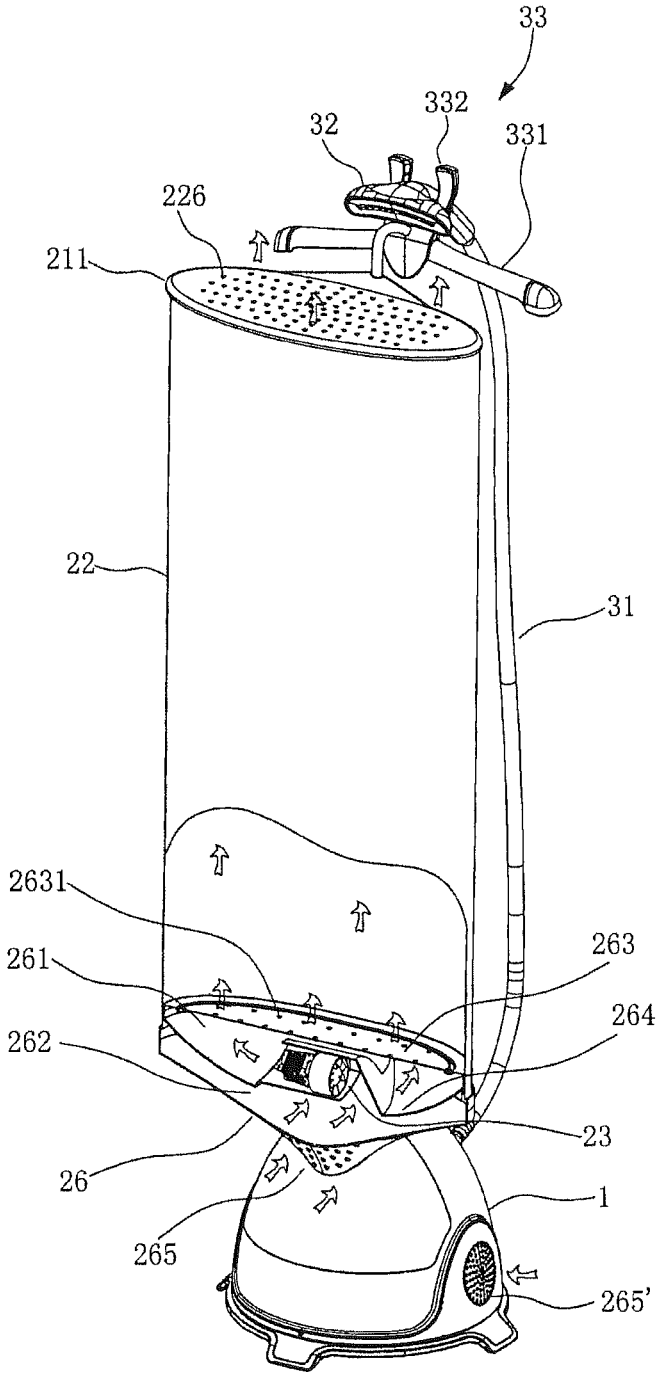
FIG. 5 is a sectional view of a chamber body of a drying-ironing combined machine according to a first embodiment of the present invention.

In the above embodiment, a hose, which hermetically connects the venting port 232 with the air inlet 225 of the hood 22, may be provided at the venting port 232 of the supporting body 1, as shown in FIGS. 1-3. Also, as shown in FIGS. 4 and 5, a chamber 26, which communicates the air inlet 225 of the hood with the venting port 232 of the heating member 23, may be provided at the bottom of the hood 22. The top plate 263 of the chamber has a top face aperture mated with that of the air inlet 225. The air inlet 225 is mounted at the periphery of the top plate 263. A plurality of venting holes 2631 is provided on the top plate 23. The bottom of the chamber 26 is hermetically communicated with the venting port 232 of the supporting body 1. The heated air flow generated by the heating member 23 enters the chamber 26 and is cooled in a buffer room formed in the chamber 26, and then, is flowed into the accommodation space 223 via the venting holes 2631 on the top plate 263, for clothes drying. The chamber 26 at the same time functions to support the lower part 220 of the hood. Outside, the chamber 26 may be mounted to the pillar 4 at its side, or may be mounted to both the pillar 4 at its side and the supporting body 1 below it. As shown in FIG. 5, further, a partition 264 is disposed within the chamber 26 and by which the chamber 26 is separated into two rooms, an upper buffer room 261 and a lower electrical appliances room 262, communicating with each other. The fan and the heating element of the heating member 23 are mounted on the partition 264 towards the electrical appliances room 262. That is, in the modified embodiment, the heating member 23 may be disposed within the chamber 23, instead of within the supporting body 1, and, in this case, intake holes 265 for supply of the external air flow are provided on a part of the chamber 26 corresponding to the electrical appliances room 262. Of courses, these intake holes may be replaced by the intake holes 265' formed on the housing of the supporting body 1, and, there may be a passageway, through which the intake holes 265' are communicated with the electrical appliances room 262, formed inside the supporting body 1.

Second Embodiment

Figure 6:
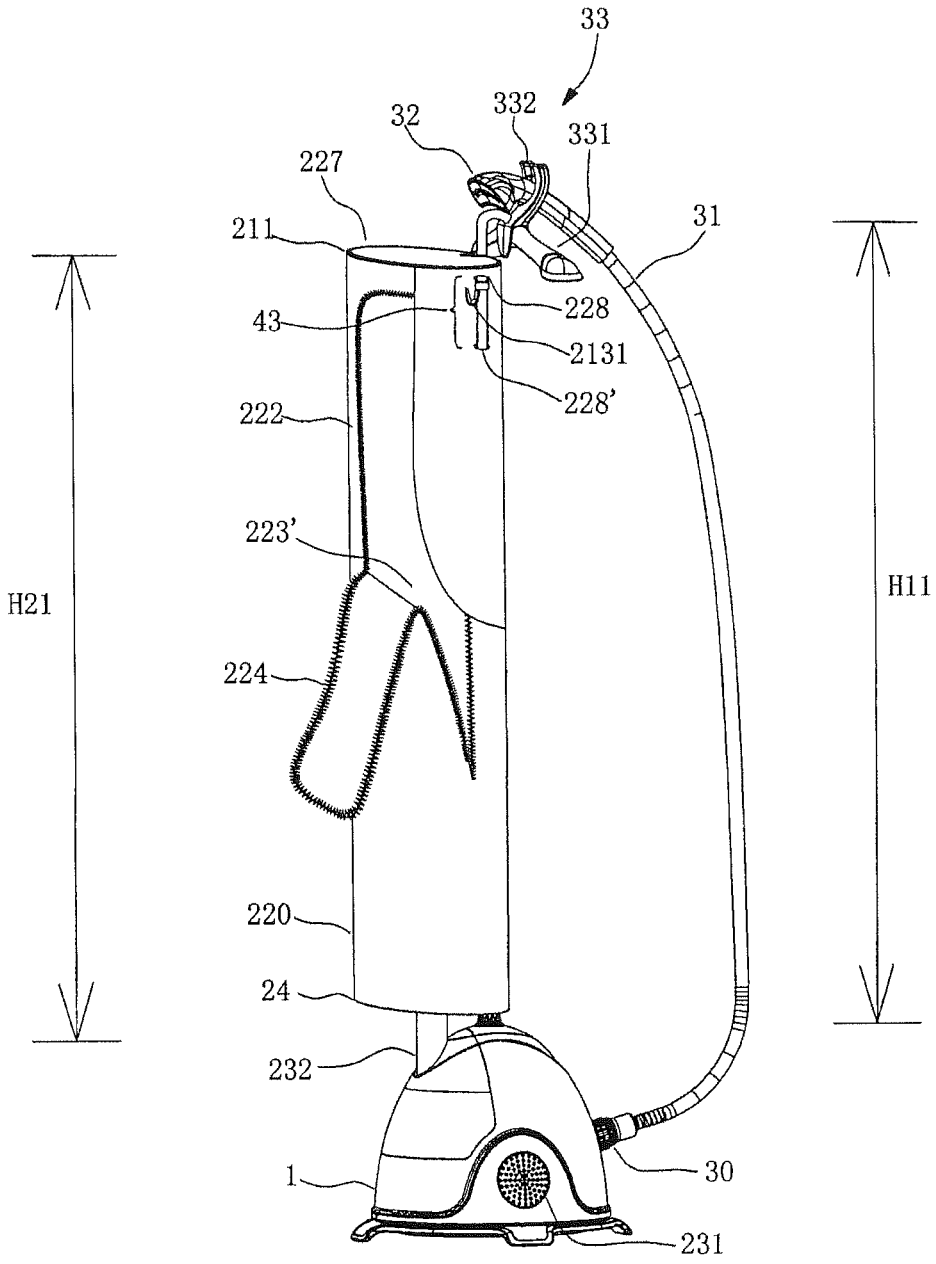
FIG. 6 is a schematically perspective view of a drying-ironing combined machine according to a second embodiment of the present invention.
Figure 7:
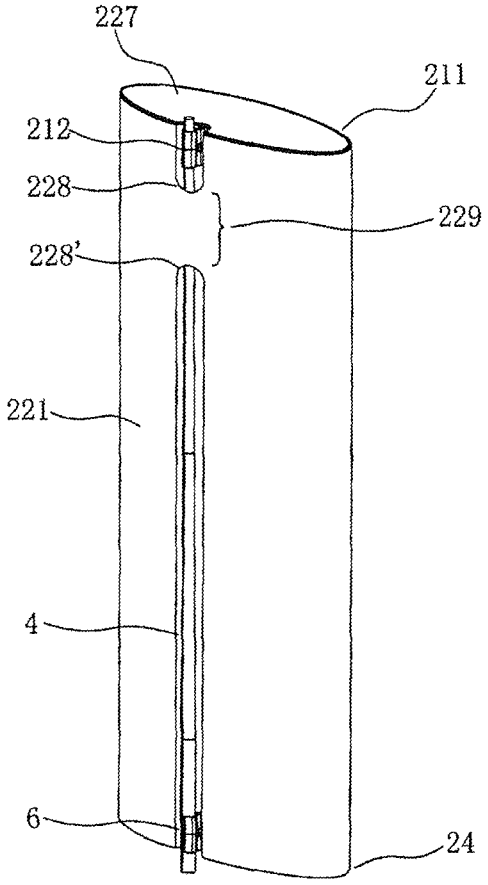
FIG. 7 is a schematic view of a hood body of a drying-ironing combined machine according to a second embodiment of the present invention.

As shown in FIGS. 6 and 7, in this embodiment, it is different from the first embodiment in the following aspects. Certain section 43 of the pillar 4 between the supporting body 1 and the drying rack member 21 passes through the accommodation space within the hood via the upper perforated hole 228 and the lower perforated hole 228', such that the certain section 43 from the upper perforated hole 228 and the lower perforated hole 228' is located in the accommodation space. In this way, the hood 22 is tied up to the pillar by mounting the back surface 221 of the hood thereto, in order to prevent excessive shaking of the whole. Further, a hanger 2131 may be provided at the certain section 43 of the pillar inside the accommodation space 223, to facilitate hanging of the clothes to be dried. Furthermore, a plurality of hangers 2131 may be provided at the certain section 43 of the pillar in the up and down direction, for hanging of the clothes.

Third Embodiment

Figure 8:
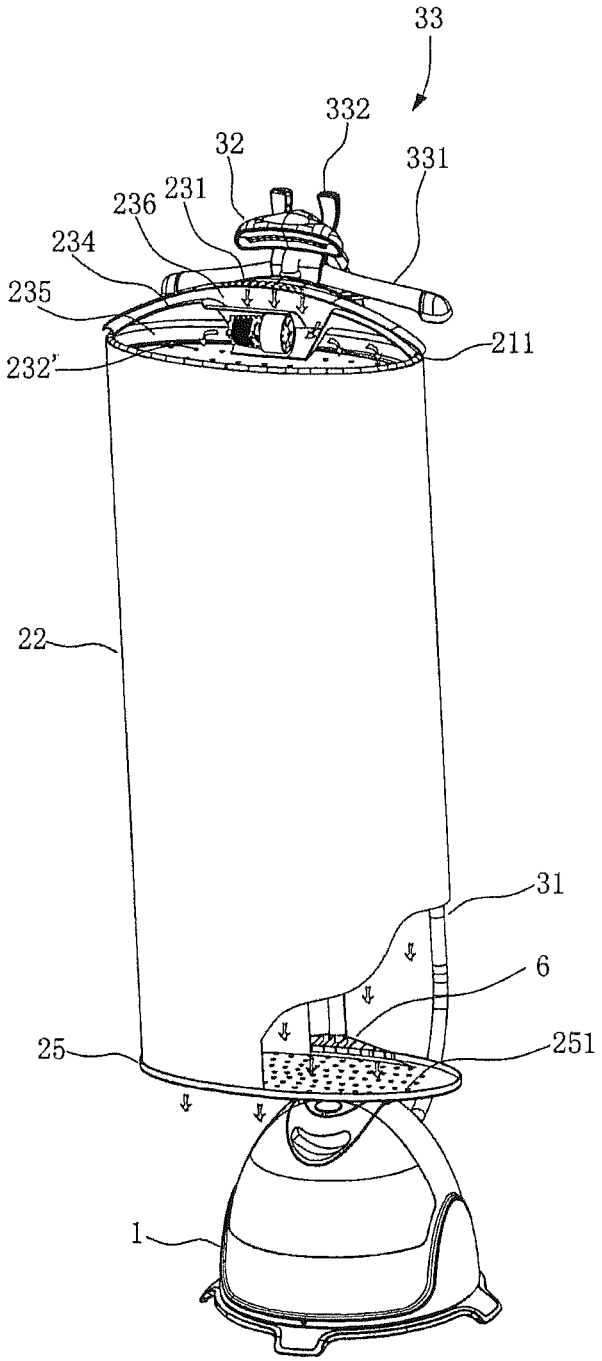
FIG. 8 is a schematically perspective view of a drying-ironing combined machine according to a third embodiment of the present invention.
Figure 9:
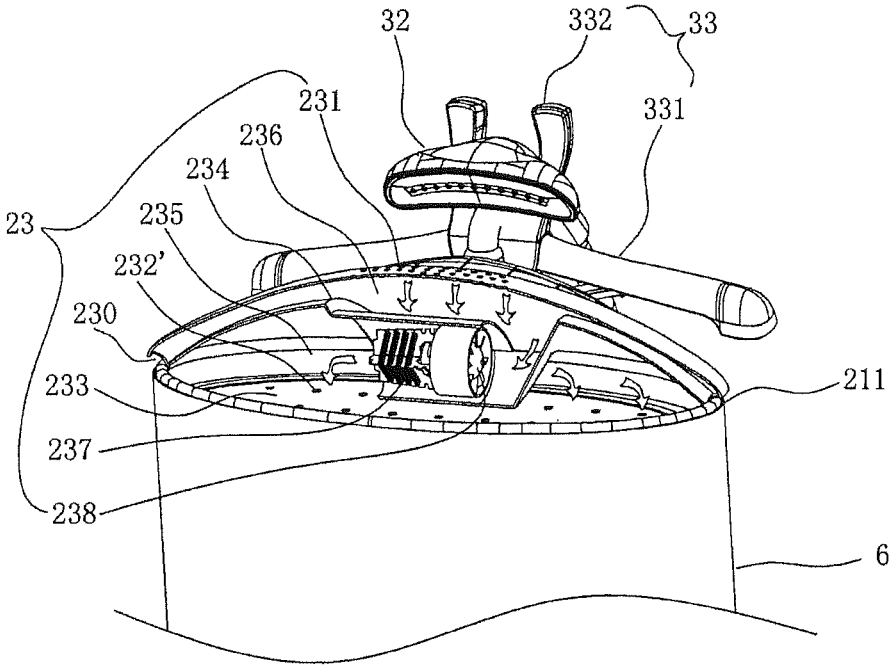
FIG. 9 is a schematic view of a heating element of a drying-ironing combined machine according to a third embodiment of the present invention.
Figure 10:
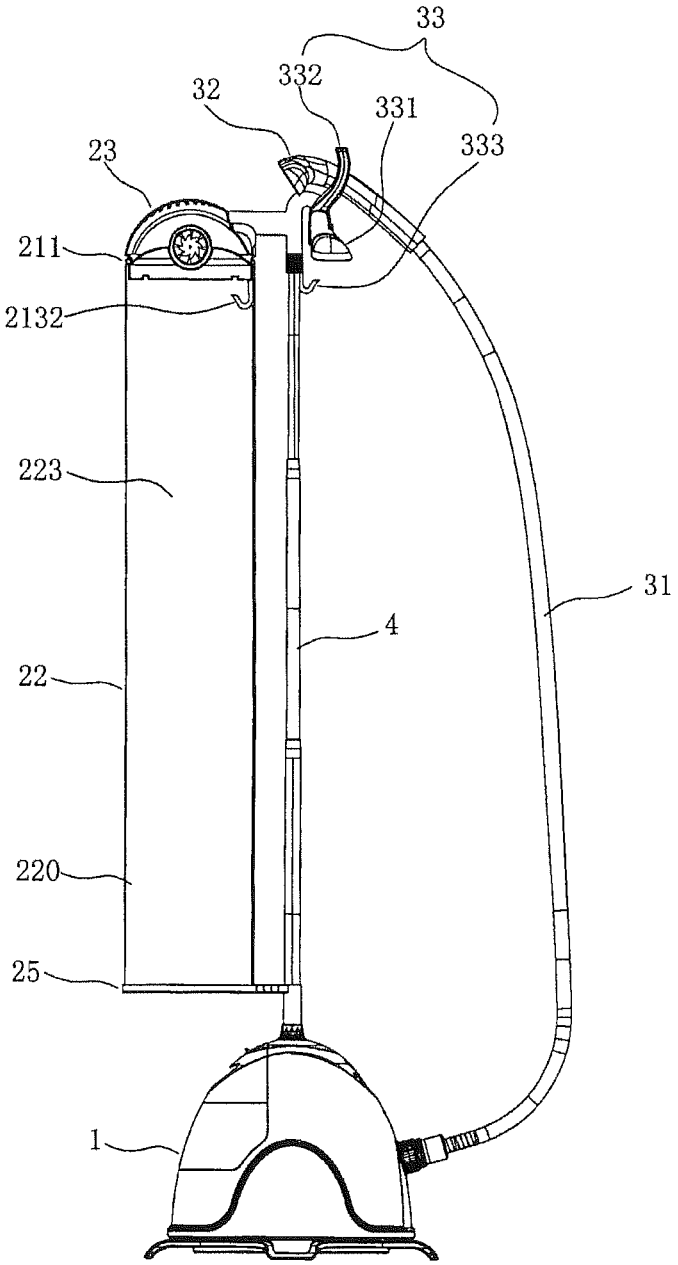
FIG. 10 is a side view of a drying-ironing combined machine according to a third embodiment of the present invention.

As shown in FIGS. 8, 9 and 10, in this embodiment, it is different from the abovementioned two embodiments in the following aspects. The heating member 23 is mounted at one side of the upper end 41 of the pillar. The upper end of the hood 22 is arranged at the periphery of the top supporting frame 211 that is mounted in a recess 230 formed outside the bottom of the housing of the heating member 23. The bottom plate 25 is fixed to the lower end of the pillar 4 by means of lateral buckle 6. The bottom plate 25 is formed with gas holes 251. A partition 234 is disposed within the housing of the heating member 23 and by which the housing of the heating member 23 is separated into two rooms, an upper electrical appliances room 236 and a lower buffer room 235, communicating with each other. The fan 238 and the heating element 237 of the heating member 23 are coaxially mounted on the partition 234 inside the electrical appliances room 236. The external air flow flows along the arrow direction shown in FIG. 9, enters into the electrical appliances room 236 via the intake openings 231 of the heating member 23. And, in the electrical appliances room 236, the air flow is absorbed by the fan 238, and is heated by the heating element 237, and then, is directed into the buffer room 235. Finally, the air flow is flowed through these venting holes 232' formed on the bottom plate 233 and into the accommodation space 223 inside the hood, and is used therein for clothes drying. In this manner, it achieves an upper heating clothes drying configuration. Further, a temperature control unit may be disposed in the buffer room 235 such that temperature of the air flow into the accommodation space 223 satisfies requirements of these clothes made by various materials. Furthermore, the housing of the heating member 23 and the ironing member 33 of the ironing unit 3 may be integrally formed. A hanger 2132 for hanging of the clothes to be dried is extended from the bottom plate 233 of the housing of the heating member 23 toward the accommodation space 223. In a similar way, a further hanger 333 for hanging of the clothes to be ironed is provided at the bottom of the clothes hanger 331 of the ironing member 33. The further hanger 333 facilitates hanging of a clothes rack with the clothes to be ironed. With this configuration, there is no need to hang the clothes to be ironed onto the clothes hanger 331 again after taking it down from the clothes rack.

Fourth Embodiment

Figure 11:
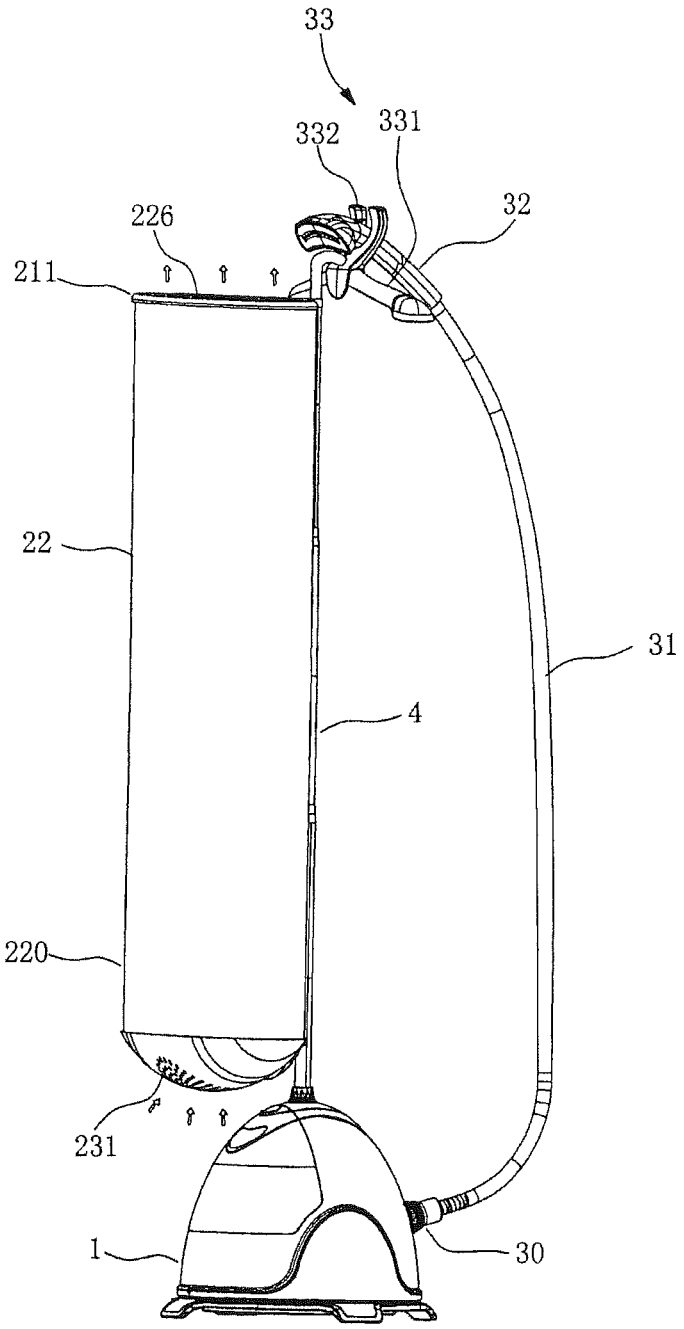
FIG. 11 is a side view of a drying-ironing combined machine according to a fourth embodiment of the present invention.
Figure 12:
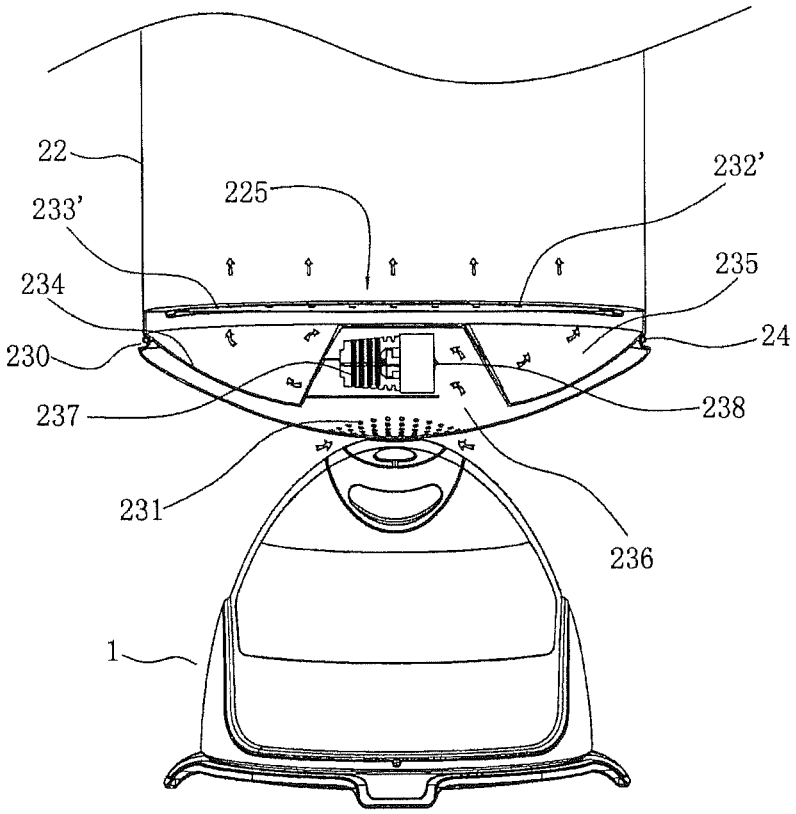
FIG. 12 is a partially side view of a drying-ironing combined machine according to a fourth embodiment of the present invention.

As shown in FIGS. 11 and 12, in this embodiment, it is different from the first embodiment in the following aspects. The heating member 23 may also be mounted at the pillar between the drying rack member 21 and the supporting body 1, which achieves a lower heating clothes drying configuration. Or, heated air flow may go out of any section of the accommodation space 223 inside the hood 22. FIGS. 11 and 12 show the lower heating clothes drying configuration. The heating member 23 is mounted at the lower end of the pillar between the drying rack member 21 and the supporting body 1. The housing of the heating member 23 is separated, by the partition 234 therein, into two rooms, an upper buffer room 235 and a lower electrical appliances room 236. The fan 238 and the heating element 237 are coaxially mounted on the partition 234 in the electrical appliances room 236 where the recess is located. The top plate 233' of the housing of the heating member 23 has a top face aperture mated with that of the air inlet 225 at the bottom of the hood 22, such that the air inlet 225 at the bottom of the hood 22 is communicated with these venting holes 232' on the top plate 233' of the heating member 23. The external air flow flows along the arrow direction shown in FIG. 12, enters into the electrical appliances room 236 via the intake openings 231 at the bottom of the housing of the heating member 23. And, in the electrical appliances room 236, the air flow is absorbed by the fan 238, and, is heated by the heating element 237, and then, is directed into the buffer room 235. Finally, the air flow is flowed through these venting holes 232' formed on the top plate 233' and into the accommodation space 223 inside the hood, and is used therein for clothes drying. In this way, it achieves a lower heating clothes drying configuration.

Fifth Embodiment

Figure 13:
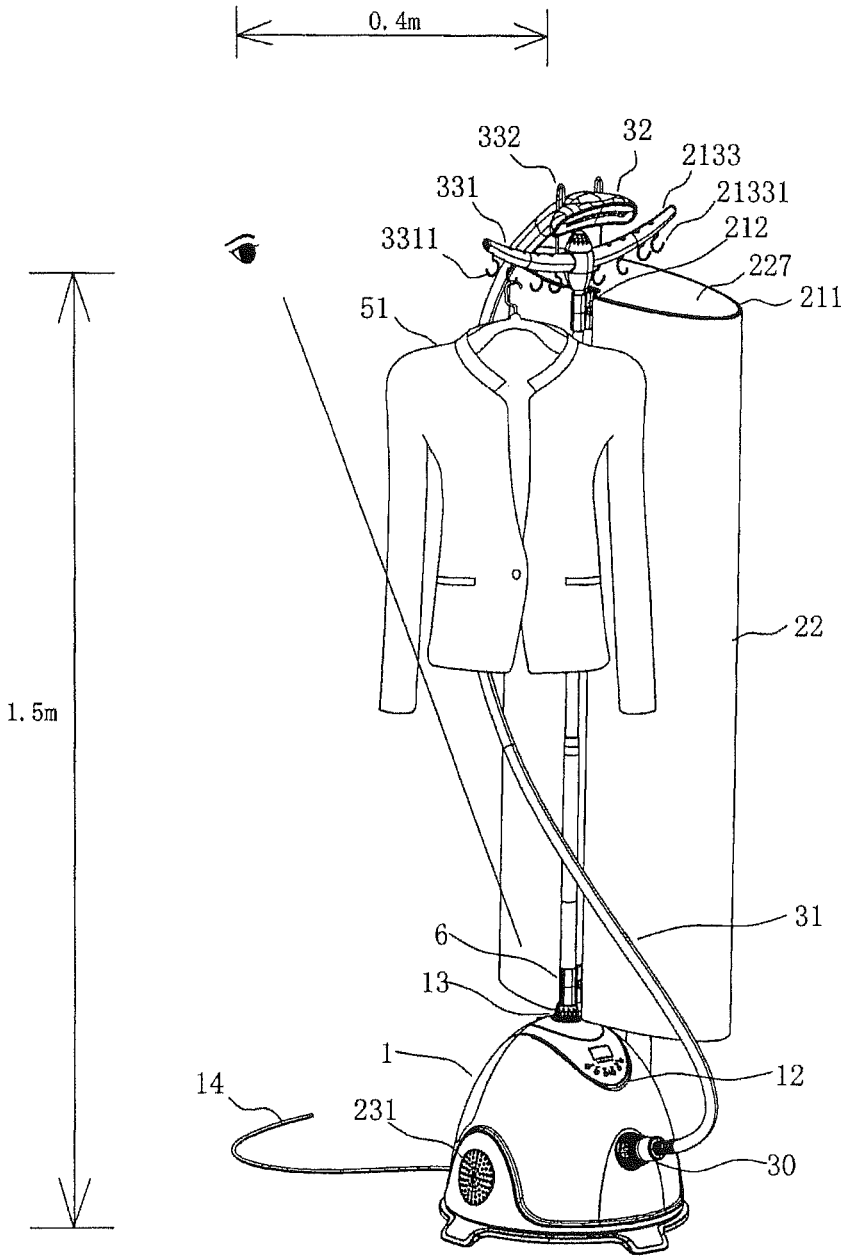
FIG. 13 is a schematically perspective view of a drying-ironing combined machine according to a fifth embodiment of the present invention.
Figure 14:
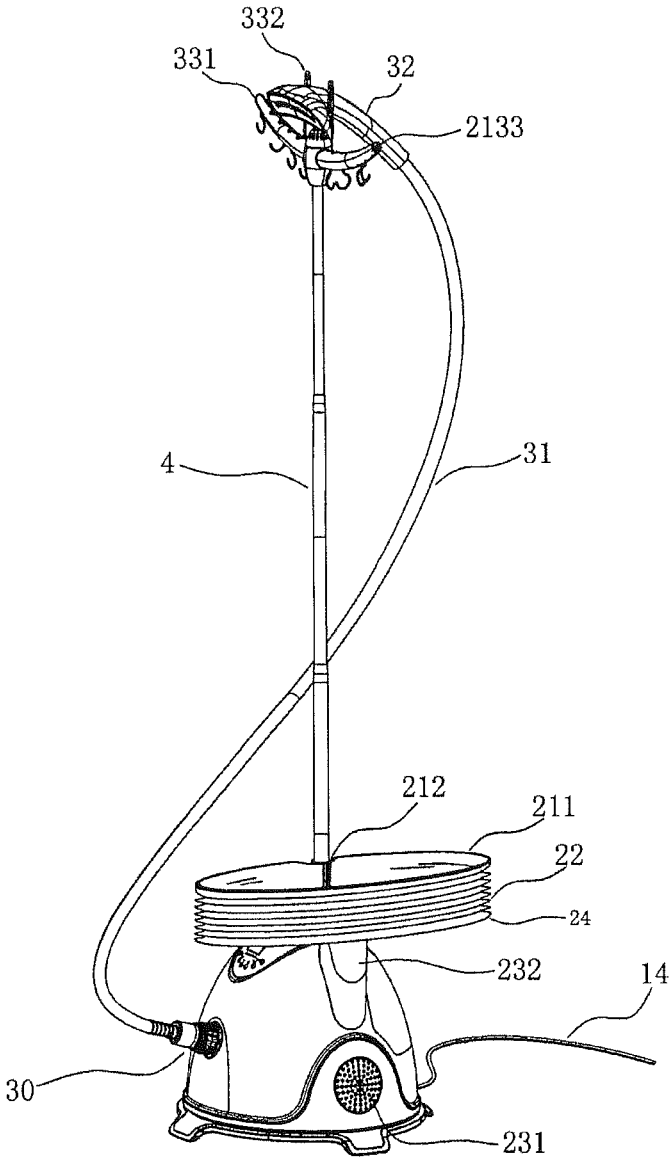
FIG. 14 is another schematically perspective view of a drying-ironing combined machine according to a fifth embodiment of the present invention.

As shown in FIGS. 13 and 14, in this embodiment, it is different from the first embodiment in the following aspects. In order to facilitate deployment of the lower part 220 of the hood and prevent the shaking, a bottom frame 24 is provided at the bottom of the hood 22. There is a lateral buckle 6 provided on the bottom frame 24, adjacent to one side of the pillar 4. The bottom frame 24 is fixed to the pillar 4 by means of the lateral buckle 6. In this way, the lower part 220 of the hood is stably mounted on the pillar 4. An accommodation space 223 of a fixed definite shape is formed between the top supporting frame 211 and the bottom frame 24, such that the hood 22 will not squeeze the clothes therein and also it facilitates pick-and-place of the clothes. Of course, the lateral buckle 6 may move up and down on the pillar 4 so that the bottom frame 24 may be moved up and down on the pillar 4 accordingly. With this construction, height of the accommodation space 223 inside the hood 22 may be changed to be suited to these clothes of different sizes. Accordingly, the clothes drying may be performed under the heated air flow in the useful space such that utilization ratio of the heated air flow is enhanced and time of clothes drying is reduced. Meanwhile, such configuration of the accommodation space 223 overcomes the disadvantage that the clothes of a larger size are stacked and crimpled together within the accommodation space due to its limited height. Similarly, as shown in FIG. 14, the top supporting frame 211, together with the lateral buckle device 212, may also be moved up and down on the pillar 4. When there is no drying of clothes, the top supporting frame 211 is moved to the lower end 42 of the pillar and closes up to the bottom frame 24 to pack up the hood, which facilitates storage of this machine. By this way, the machine can be served as a clothes hanging device. Similarly, as shown in FIGS. 8 and 10, the bottom plate 25 may be replaced by the bottom frame 24, and, there may be some gas holes 251 for air flow are formed on the bottom plate 25.

As shown in FIG. 13, the control panel 12 is provided at the supporting body 1, beyond the area where the hood 22 is orthodox projected. This is different from the conventional configuration where the conventional hood wholly covers over the supporting body so that the control panel is obstructed. With this construction, during the operation, the operator need not to leave from the supporting body about 0.4 mm and squat to skim over the hood, in order to observe the control panel for the status of the clothes drying, instead, the operator only stands in the clothes ironing region B as shown in FIG. 2 or a transitional region C directly to observe the control panel for the status of the clothes drying.

Sixth Embodiment

Figure 15:
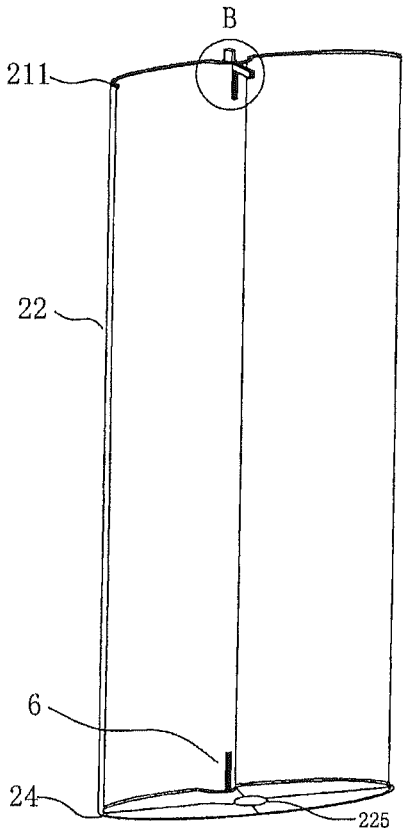
FIG. 15 is an inside view of a hood body of a drying-ironing combined machine according to a sixth embodiment of the present invention.
Figure 16:
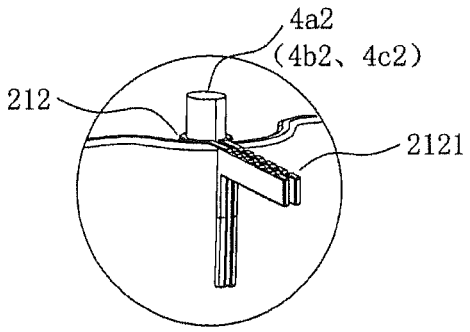
FIG. 16 is an enlarged view of a section B in FIG. 15.

As shown in FIGS. 15 and 16, in this embodiment, it is different from the abovementioned embodiments in the following aspects. The drying rack member 21 in the drying unit 2 further comprises a hanger for hanging of the clothes to be dried. The hanger is embodied as a prominent arm 2121 extended from the lateral buckle device 212 of the hood 22 toward the accommodation space 223. Provision of the hanger achieves the hanging of the clothes to be dried inside the hood 22. There are some positioning recesses on the prominent arm 2121, in order for keeping these clothes to be dried away from each other. This facilitates flowage of the heated air flow and speeds up the time the heated air flow goes through the clothes to be dried and improves efficiency of the clothes drying. Of course, the hanger may be embodied as a hooker structure extended from the lateral buckle device 212 toward the accommodation space 223.

Seventh Embodiment

Figure 17:
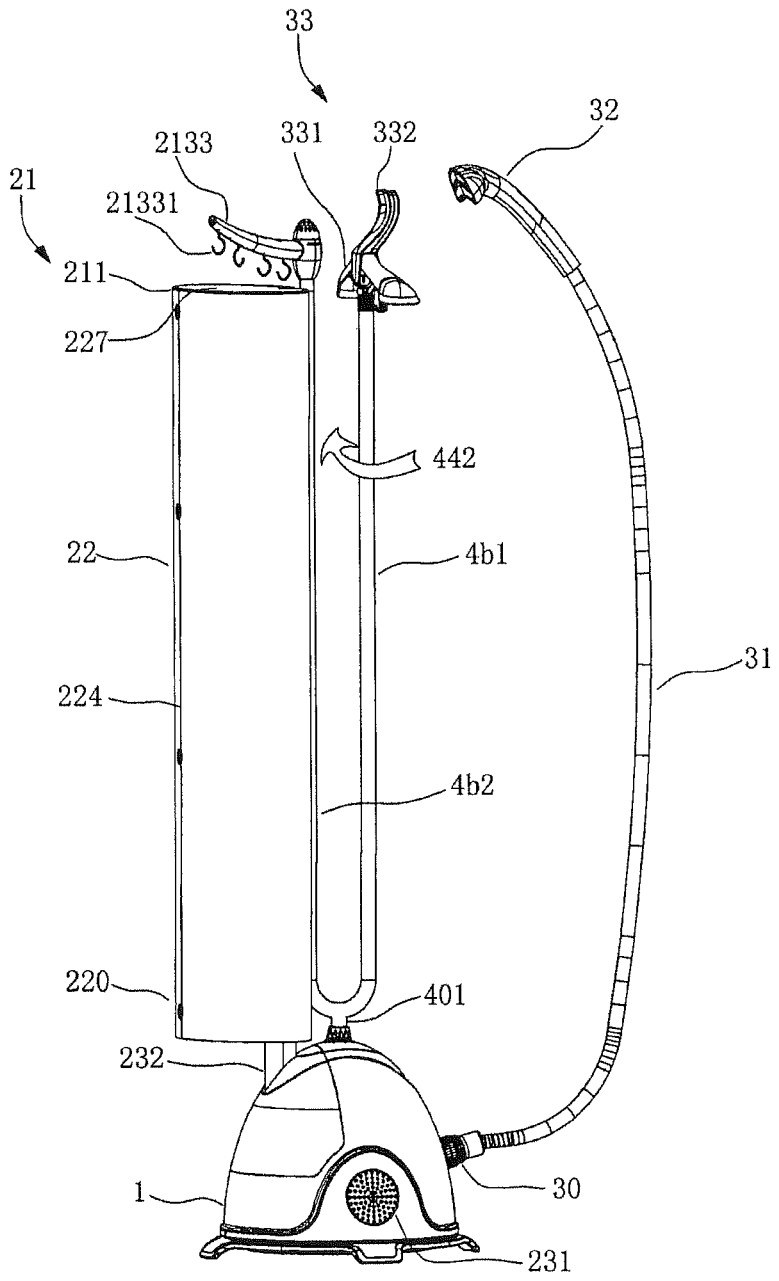
FIG. 17 is a schematic view of a drying-ironing combined machine according to a seventh embodiment of the present invention.

As shown in FIG. 17, in this embodiment, it is different from the abovementioned sixth embodiment in the following aspects. The hanger is provided on a first extension arm 2133 that is projected towards the hood 22 from the upper end of the supporting rod **4*b*2. There is a plurality of hookers 21331 for hanging of the clothes provided at the first extension arm 2133. The clothes to be dried will be placed into the accommodation space 223 through the clothes pick-and-place door 224 at the front surface 222 of the hood. A clothes rack for hanging of the clothes to be dried may be disposed on the hooker 21331 through an upper opening at the top of the hood 22. The drying operation is performed after the clothes pick-and-place door 224 is closed. With this construction, the upper opening 227 at the top of the hood 22 serves as the air outlet. Alternatively, as shown in FIGS. 13 and 14, the ironing member 33 is provided with a further hanger, which, together with the hanger of the drying unit 2, makes the extension arm at the upper end 41 of the pillar. The first extension arm 2133 at one side of the drying unit 2 is provided with a plurality of hookers 21331, correspondingly, the second extension arm 331 of the ironing unit 3 is provided with hookers for hanging of the clothes to be dried. A retaining shelf 332 for holding a steam sprayer 32** is provided at the top end of the central axis of the extension arm.

Eighth Embodiment

Figure 18A:
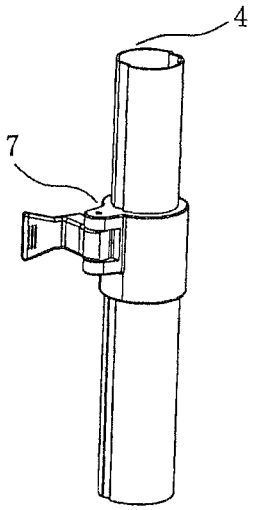
FIGS. 18*a*, 18*b* are schematic views of an upright pillar according to an eighth embodiment of the present invention, in which the upright pillar is in an unlocked and telescopic state in FIG. 18*a* but in a locked and mounted state in FIG. 18*b*.
Figure 18B:
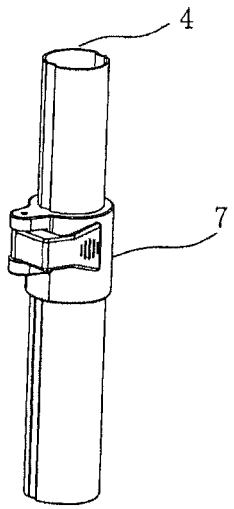
Figure 19:
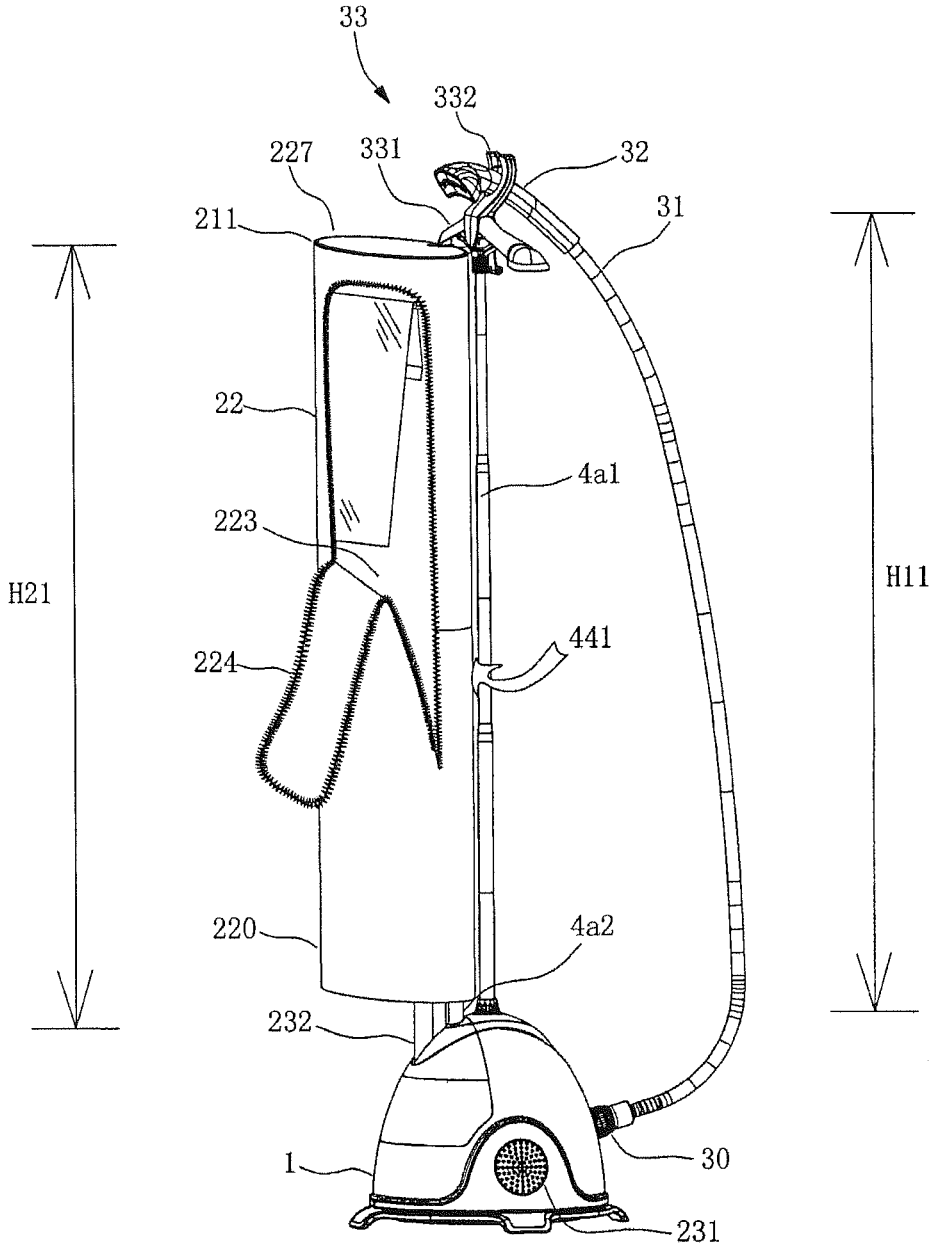
FIG. 19 is a schematic view of a drying-ironing combined machine according to a ninth embodiment of the present invention.
Figure 20:
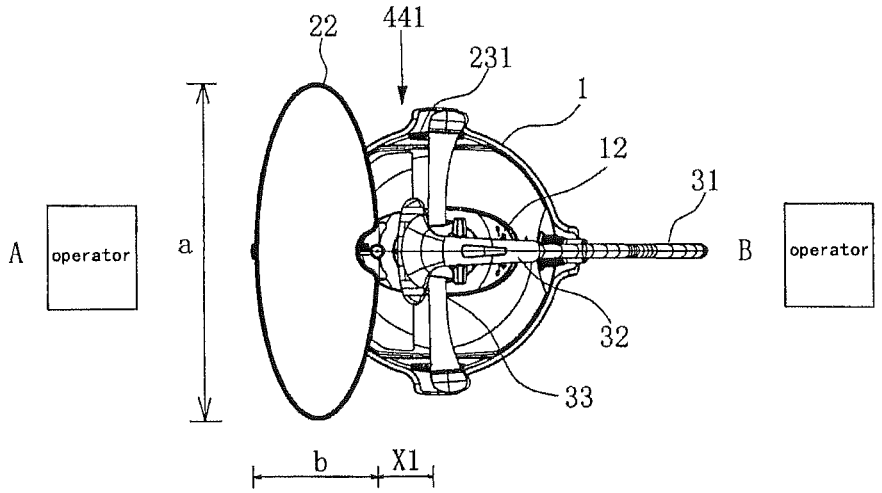
FIG. 20 is a top view of a drying-ironing combined machine according to a ninth embodiment of the present invention.

As shown in FIG. 18, in this embodiment, it is different from the abovementioned embodiments in the following aspects. FIGS. **18*a* and 18*b* show two different states of the pillar 4, respectively. The pillar 4 has several sections arranged in a telescopic configuration and tapered from the bottom to the top. Loose units 7 are provided at connections among the adjacent sections. In this embodiment, the loose unit comprises a spanner at one end having a cam structure and at the other end hinged to the casing pipe sleeved on the pillar. By turning the spanner, the pillar is loosened or tightened in such a manner that the one end of the spanner is abut against the wall of the pillar or is away from the pillar. In this way, height of the pillar 4 is varied by drawing, sliding and fastening actions, in order to meet requirements of different users. Alternatively, the pillar 4 has several sections arranged in a retractable manner. When there is no need to clothes ironing, the pillar 4 is detached from the supporting body 1, the lateral buckle device 212 and the lateral buckle 6 is drawn out from the pillar 4, the hood 22 is packed up by gathering the top supporting frame 211 and the bottom frame 24 or the bottom plate 25, and these sections of the pillar 4** are retracted, for storage and portability. However, except for the telescopic configuration, there are many other configurations for the pillar, for example, a detachable configuration consisted of several sections.

Ninth Embodiment

Figure 22:
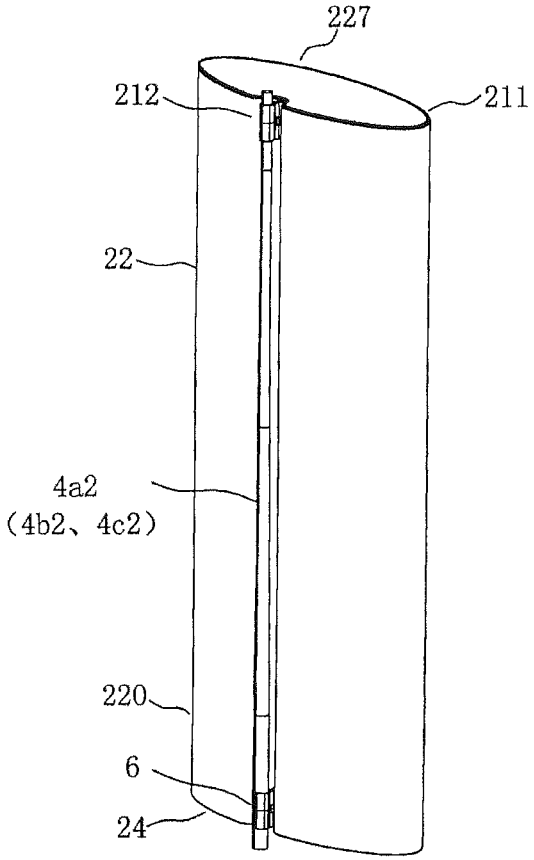
FIG. 22 is a back schematic view of a hood body according to a ninth embodiment of the present invention.

As shown in FIGS. 19, 20 and 21, 22, in this embodiment, it is different from the first embodiment in the following aspects. The pillar 4 is divided into two parts, a first supporting rod **4*a*1 with a predetermined height H11 and a second supporting rod 4*a*2 with a predetermined height H21. The first 4*a*1 and second 4*a*2 supporting rods are vertically and separately mounted between the venting port 232 and the steam outlet port 30. The first and second supporting rods are parallel to each other so as to be arranged in a "‖" configuration. The horizontal distance X1 between the two supporting rods is optimally ranged from 10 cm to 25 cm such that the steam sprayer 32 may easily pass through a passageway 441 formed between two supporting rods and perform the ironing operation on back surfaces of the tops. The drying rack member 21 comprises a top supporting frame 211 disposed at the top end of the hood 22, a lateral buckle device 212 fixing the top supporting frame 211 to the second supporting rod 4*a*2. The top supporting frame 211 is in an elliptic shape and forms the upper opening 227 (i.e., the outlet opening). The top supporting frame has an accommodation width a corresponding to a shoulder width of the tops 51 and an accommodation thickness b corresponding to a chest and back thickness of the tops 51. The lateral buckle device 212 is mounted at the peripheral of the top supporting frame 211 in the middle along the direction of the accommodation width a. The hood 22 has its upper end hung on the top supporting frame 211. The top supporting frame 211 is mounted to the lateral buckle device 212 (as shown in FIG. 22) and is fixedly connected to the second supporting rod 4*a*2 via the lateral buckle device 212, thereby the hood 22 is mounted to the second supporting rod 4*a*2. The hood 22 is developed along the axial direction of the second supporting rod 4*a*2 to form the accommodation space 223. The upper opening 227 of the hood 22 is kept in an upward manner so that the accommodation space 223 of the hood 22 is large enough. The clothes pick-and-place door 224 is opened at the lateral front surface 222 of the hood 22. The hood has an air outlet 226 at its upper end and an air inlet 225 at its lower end (as shown in FIG. 15). The air inlet 225 is hermetically connected to the venting port 232 such that the heated air flow from the heating member 23 is directed to the accommodation space 223 of the hood 22, to drying the clothes therein, and, water vapor generated from the clothes passes through the upper opening 227 at the upper end of the hood 22** and is discharged to the environments.

The ironing member 33 is provided at the upper end of the first supporting rod **4*a*1, and it comprises the clothes hanger 331 for hanging of the clothes to be ironed and the retaining shelf 332 for holding of the steam sprayer 32. The tops to be ironed 51 is passed through the passageway 441 at a distance of X1 between the first 4*a*1 and the second 4*a*2 supporting rods and is hung on the clothes hanger 33** (as shown in FIG.

21), at the other hand, the steam sprayer 32 is taken out from the retaining shelf 332 to perform the ironing operation on the tops 51. The operator performs the pick-and-place working and the ironing operation of the clothes within the clothes drying region A at the left side of the second supporting rod 4*a*2 and performs the drying operation on the front surfaces of the tops within the clothes ironing region B at the lateral side of the second supporting rod 4*a*2. Since existence of the passageway 441 at a horizontal distance of X1 between the two supporting rods, the steam sprayer 32 may freely go through the passageway 441 and apply the drying on the back surface of the tops. The hood 22 located at the left side of the second supporting rod 4*a*2 does not bring any interference into the ironing operation. Accordingly, the ironing operation and the drying operation can be performed simultaneously, without interference with each other.

Tenth Embodiment

Figure 24:
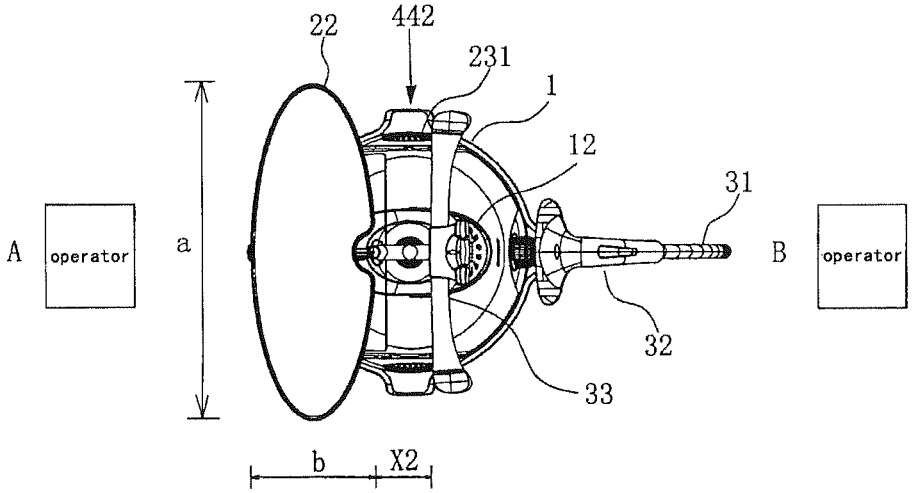
FIG. 24 is a top view of a drying-ironing combined machine according to a tenth embodiment of the present invention.
Figure 21:
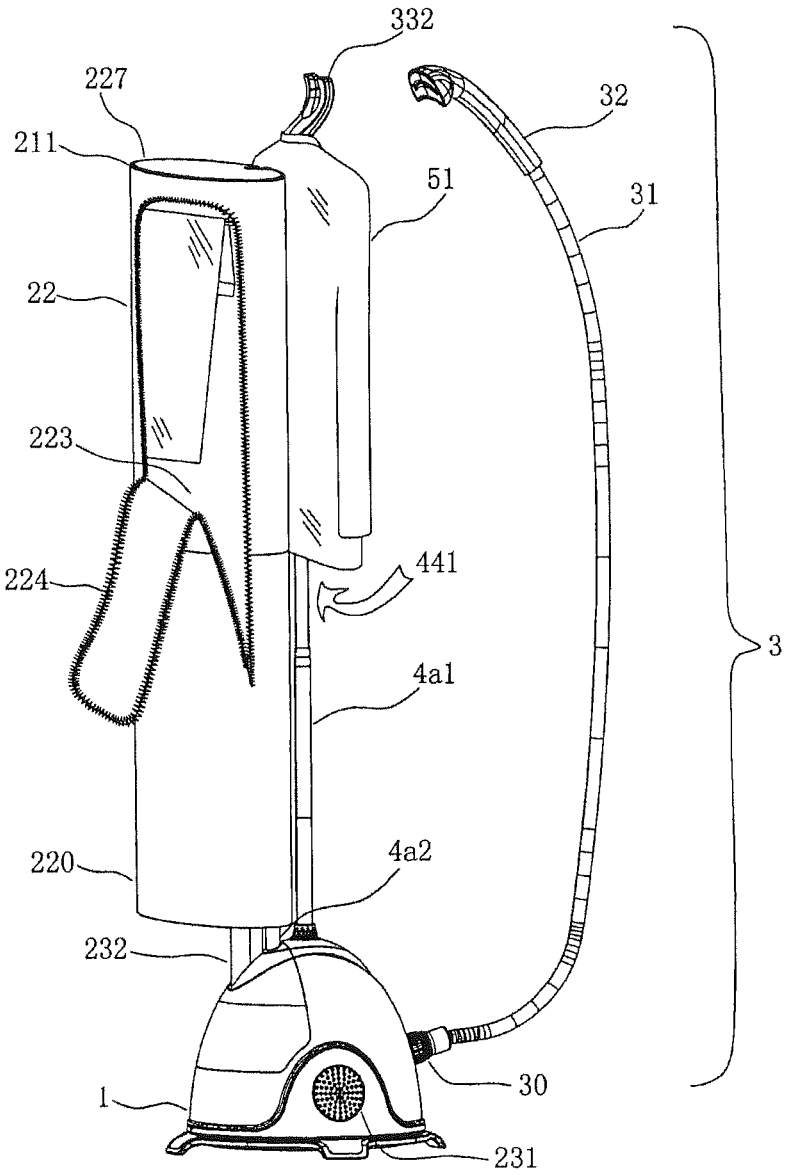
FIG. 21 is a schematic view of a working state of a drying-ironing combined machine according to a ninth embodiment of the present invention.
Figure 23:
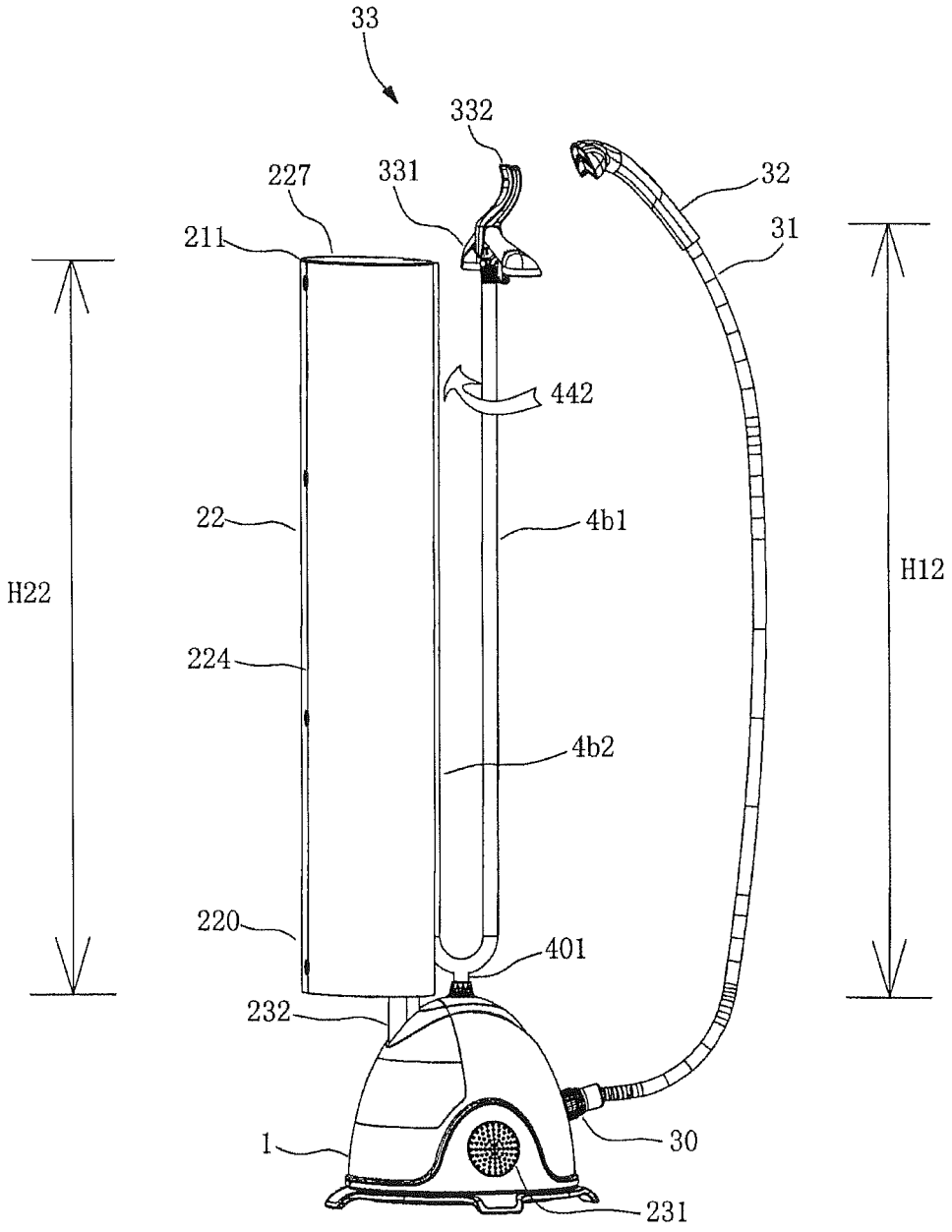
FIG. 23 is a side view of a drying-ironing combined machine according to a tenth embodiment of the present invention.

As shown in FIGS. 23, 24 and 17, in this embodiment, it is different from the ninth embodiment in the following aspects, except for the components as the same as those in the ninth embodiment. The pillar 4 comprises a first supporting rod 4*b*1 with a predetermined height H12 and a second supporting rod 4*b*2 with a predetermined height H22, in the longitudinal direction. The first and second supporting rods have upper parts thereof horizontally spaced by a predetermined distance X2 and lower parts combined together via the stub 401 so that the pillar is arranged in a substantially "Y" configuration. A passageway 442 is formed between the first supporting rod 4*b*1 and the second supporting rod 4*b*2.

Eleventh Embodiment

Figure 25:
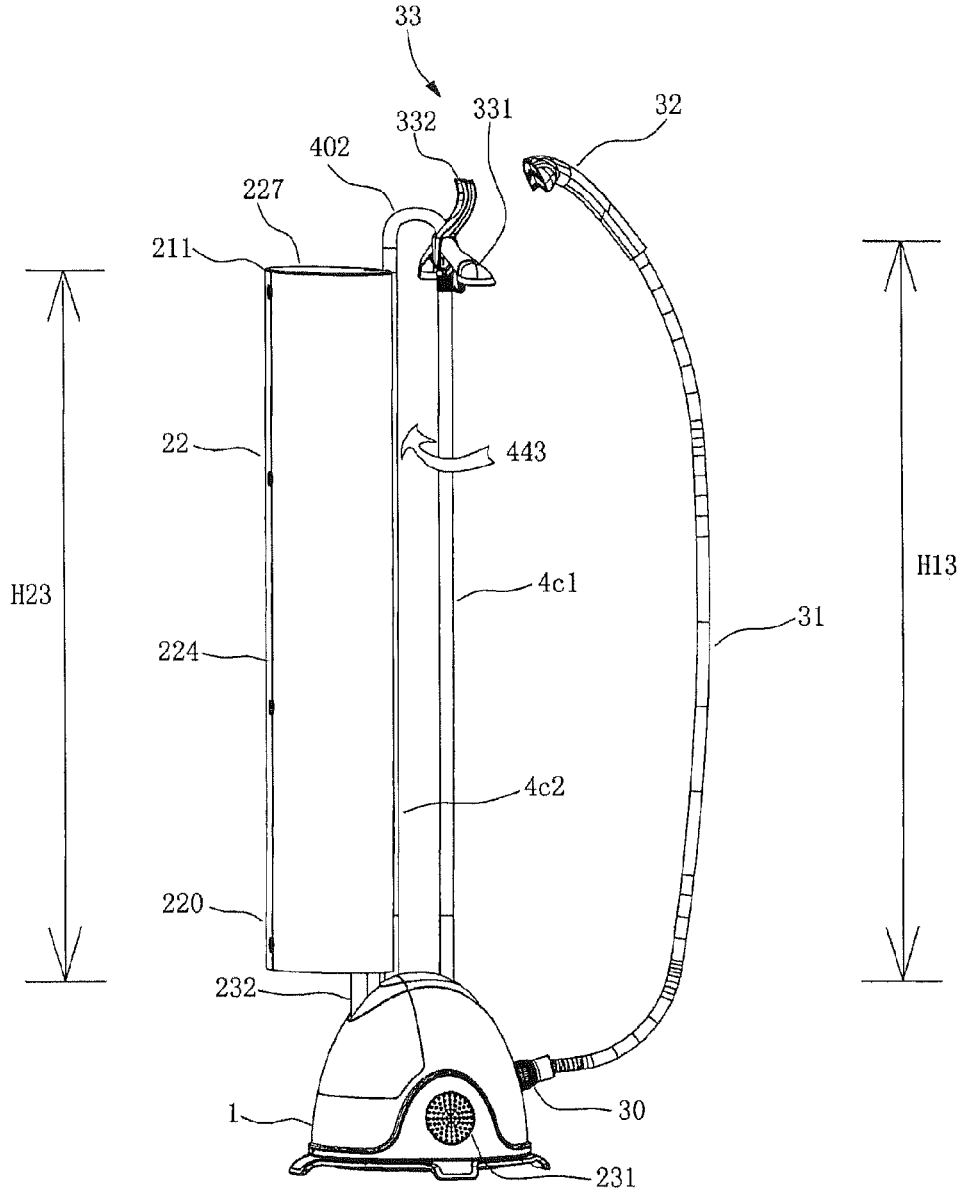
FIG. 25 is a side view of a drying-ironing combined machine according to an eleventh embodiment of the present invention.
Figure 26:
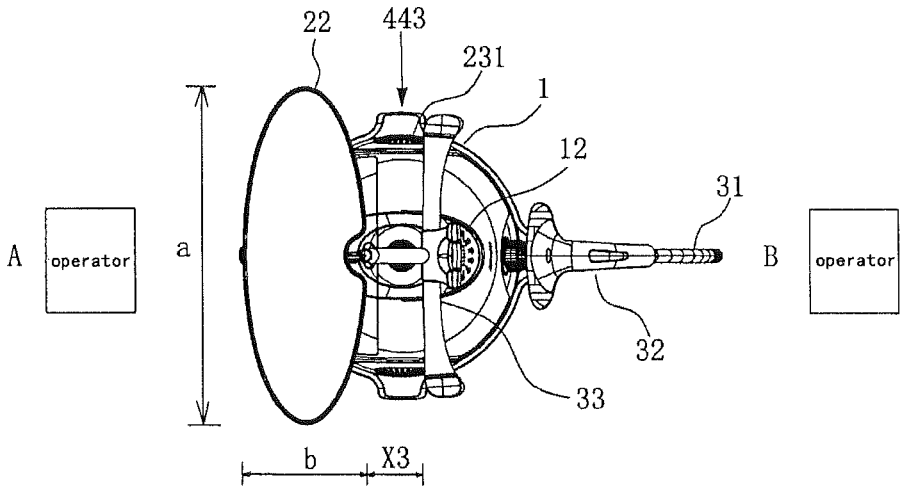
FIG. 26 is a top view of a drying-ironing combined machine according to an eleventh embodiment of the present invention.

As shown in FIGS. 25 and 26, in this embodiment, it is different from the ninth and tenth embodiments in the following aspects. The pillar comprises a first supporting rod 4*c*1 with a predetermined height H13 and a second supporting rod 4*c*2 with a predetermined height H23, in the longitudinal direction. The first and second supporting rods have upper parts thereof connected with each other via a linking member 402 so that the pillar is generally arranged in a substantially "n" configuration. A passageway 443 is formed between the two supporting rods. With such configuration, the pillar 40 is stable relatively. Shaking of the two supporting rods is reduced in some extents by connecting the upper parts of the first and second supporting rods together by virtue of the linking member 402.

Twelfth Embodiment

Figure 29:
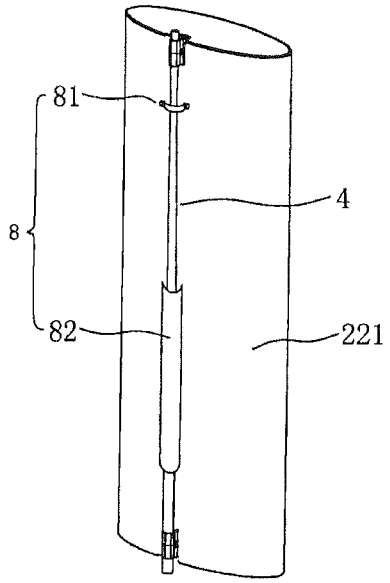
FIG. 29 is a back schematic view of a hood body of a drying-ironing combined machine according to a twelfth embodiment of the present invention.
Figure 27:
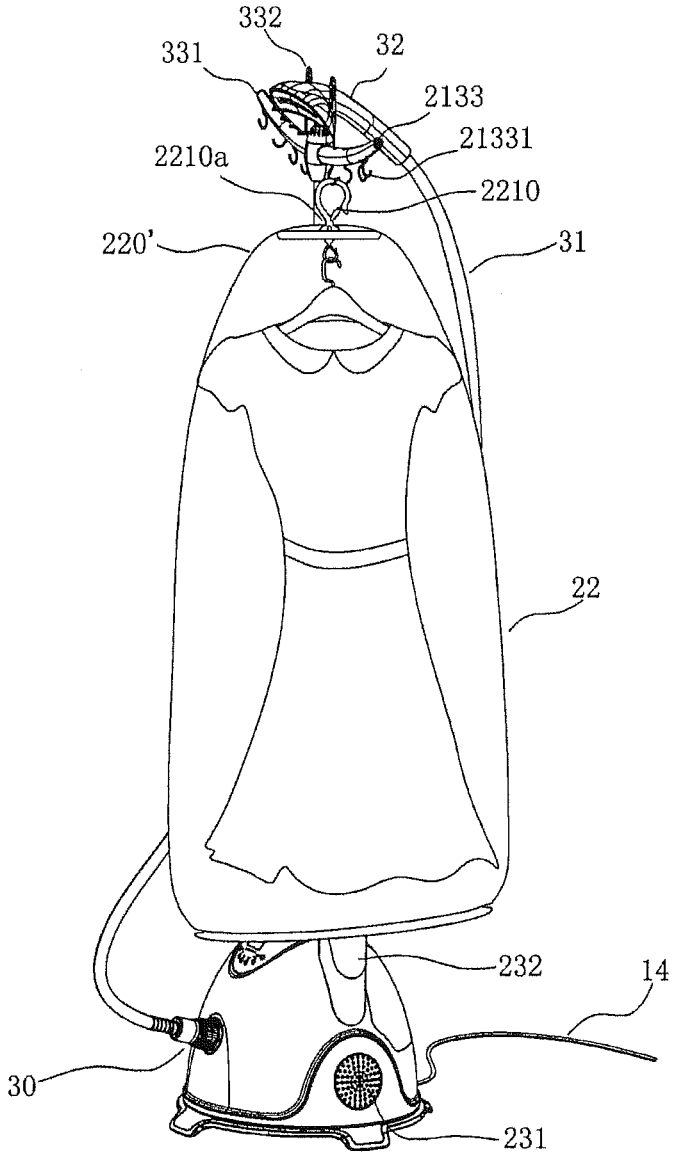
FIG. 27 is a schematic view of a drying-ironing combined machine according to a twelfth embodiment of the present invention.
Figure 28:
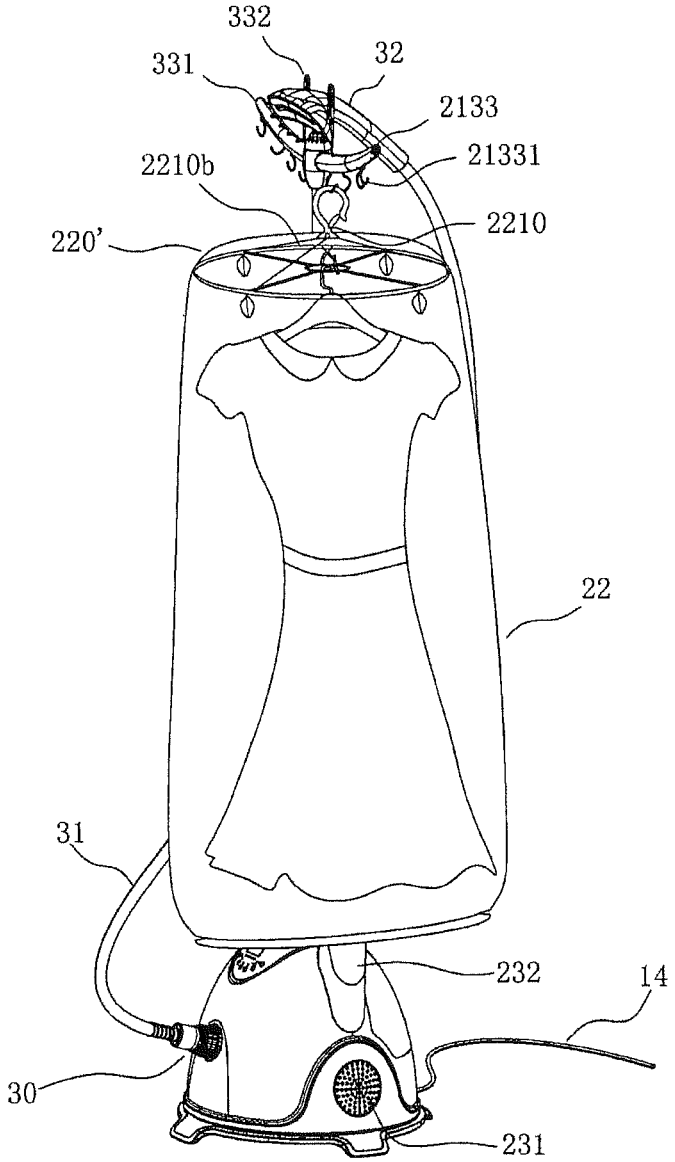
FIG. 28 is a partially perspective view of a drying-ironing combined machine according to a twelfth embodiment of the present invention.

As shown in FIGS. 27, 28 and 29, in this embodiment, it is different from the first embodiment in the following aspects. A stretching mechanism 2210 is provided at the top 220' of the hood and for stretching the top 220' of the hood. The stretching mechanism 2210 comprises a clothes hanging arrangement 2210*a* and a discoid arrangement 2210*b* for stretching the upper end of the hood 22. A first extension arm 2133 is extended from the upper end of the pillar towards the left and has a hanger 21331 thereon. The clothes hanging arrangement 2210*a* is hung on the hanger 21331 such that the hood 22 is fixed on the left of the pillar 4 and develop in a naturally hanging-down manner along the stretching mechanism 2210.

As shown in FIG. 29, based on the above, a fastening mechanism 8 is provided between the back surface 221 of the hood and the pillar 4, in order to prevent shaking in the longitudinal direction of the hood 22 relative to the pillar 4. The fastening mechanism 8 comprises a fastener member 81 mounted on the back surface 221 of the hood and a bushing member 82 through which the pillar passes.

Thirteenth Embodiment

As shown in FIG. 30, the heating member 23 may be located on any point of the pillar 4. As shown in FIG. 30*a*, the heating member 23 is located on the top of the pillar 4, over the drying rack member 21. The venting port 232 of the heating member 23 is opened towards the hood 22. The heating member 23 has an intake opening 231 at the top of the heating member 23. Namely, the top of the hood 22 is embodied as the air inlet 225. The hood 22 has a plurality of venting holes 28 at the bottom thereof, namely, the air outlet of the hood. Further, a bottom plate or bottom frame 24 is provided at the bottom of the hood.

Figure 30A:
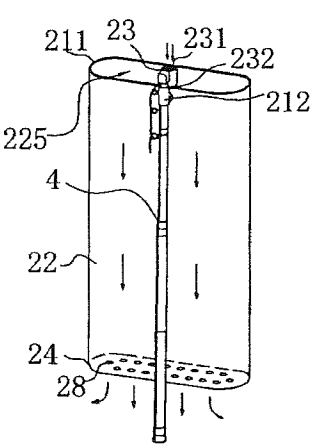
Figure 30B:
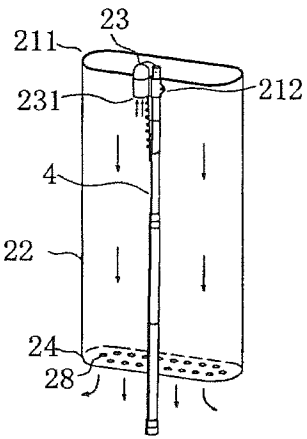

As shown in FIG. 30*b*, the heating member 23 is also located on the top of the pillar 4, but the air inlet of the hood 22 is not the air inlet 225 opened in the top of the hood 22. The venting port of the heating member 23 is communicated with the air inlet of the hood 22. The hood 22 has also a plurality of venting holes 28 at the bottom thereof. Further, a bottom plate or bottom frame 24 is provided at the bottom of the hood.

Figure 30C:
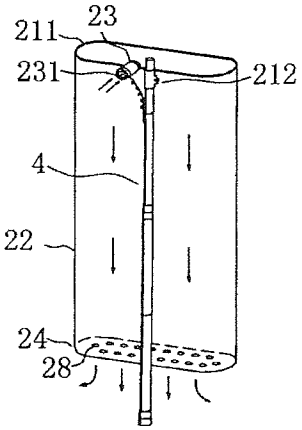

As shown in FIG. 30*c*, the heating member 23 is located on top supporting frame 211 at the top of the pillar 4. The venting port of the heating member 23 is communicated with the hood 22. As shown in FIG. 30*b*, the venting port is communicated with the air inlet of the hood 22. Or, as shown in FIG. 30*a*, the venting port is directly opened towards the air inlet 225 at the top of the hood 22.

Figure 30D:
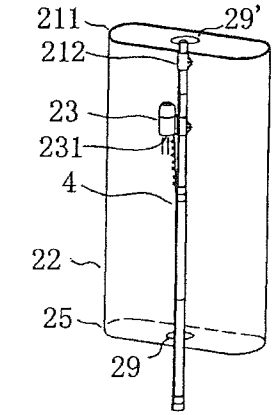

As shown in FIG. 30*d*, the heating member 23 is mounted on the center of the pillar 4 between the drying rack member 21 and the supporting body 1. The heating member 23 has an intake opening 231, and the venting opening is communicated with the air inlet of the hood 22, in order to supply the hot air towards the hood 22. A large venting hole 29 formed on the bottom plate 25 at the bottom of the hood 22 or a large venting hole 29' formed on the top of the hood 22 or both the large venting hole 29, 29' is/are embodied as the air outlet of the hood 22.

Figure 30E:
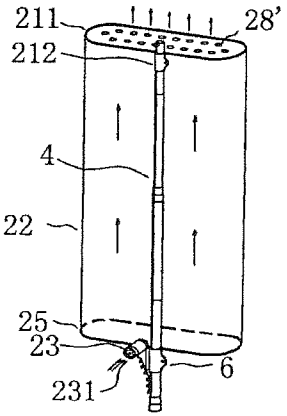

As shown in FIG. 30*e*, the heating member 23 is located on the bottom of the pillar 4 as the same as that in FIG. 30*b*, but the air inlet of the hood 22 is located on other point of the hood 22. The heating member 23 has an intake opening 231. The venting port of the heating member 23 is communicated with the air inlet of the hood 22. Further, a bottom plate 25 or bottom frame is provided at the bottom of the hood and is fixed to the pillar 4 by virtue of the lateral buckle 6. The hood 22 has also a plurality of venting holes 28' at the top thereof.

Figure 30F:
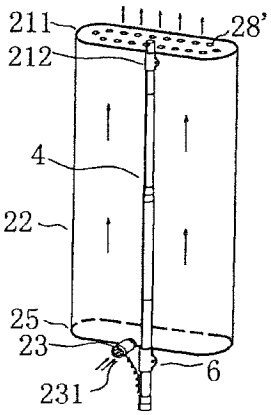

As shown in FIG. 30*f*, the heating member 23 is located on the bottom of the pillar 4, but, it is different from that in FIG. 30*b* in that the heating member 23 is mounted to a bottom plate 25 or bottom frame at the bottom of the hood. The venting port of the heating member 23 is communicated with the air inlet of the hood 22. The bottom plate 25 or bottom frame is fixed to the pillar 4 by virtue of the lateral buckle 6. The hood 22 has also a plurality of venting holes 28' at the top thereof.

Accordingly, the heating member 23 may be located on any point of the pillar 4 between the drying rack member 21 and the supporting body 1. That is, the heating member 23 may be located on the pillar above the drying rack member 21, or on the center of the pillar 4 between the drying rack member 21 and the supporting body 1, or on the bottom of the pillar 4, or even on the drying rack member 21, or on the bottom frame 24 or the bottom plate 25 at the bottom of the hood 22. This provides various configurations for the users to choose from.

Fourteenth Embodiment

Figure 31:
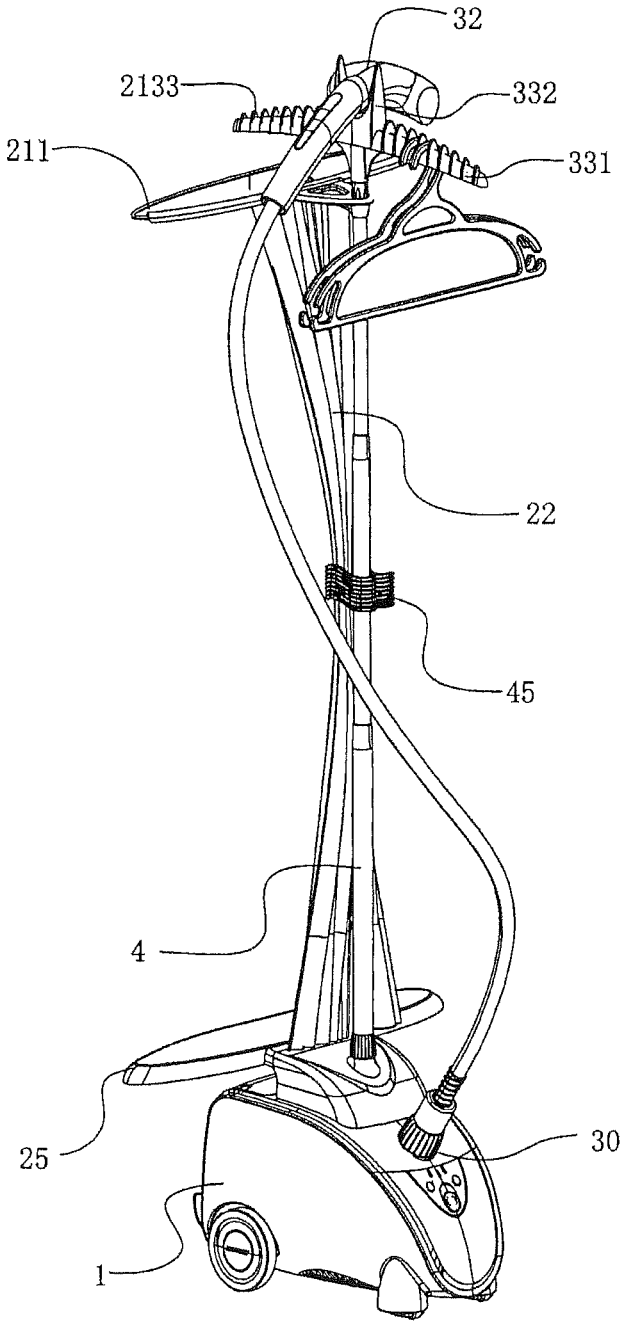
FIG. 31 is a schematic view of a drying-ironing combined machine according to a fourteenth embodiment of the present invention.

As shown in FIG. 31, these in this embodiment are substantially the same as those in the fifth embodiment, except for a binding unit. In this embodiment, a binding unit 45 is provided in the middle of the pillar 4, namely, is a clamp mounted on the pillar 4. In this embodiment, the hood 22 may be gathered from the top supporting frame 211 at the top thereof to the bottom plate 25 at the bottom thereof, and vice verse, to be located aside the pillar 4. The gathered hood 22 may be tied up onto the pillar 4 by means of the binding unit 45, such that the hood 22 may be packed up, to reduce volume of the machine when it is not in use.

Of course, the binding unit 45 may be embodied as a kind of sticky buckle. Alternatively, the binding unit 4 is a strap having one end located on the hood. Such strap has mated stubs at both ends thereof, respectively. For binding of the hood, one end of the strap goes around the pillar and then the stub on the one end is mated with the other on the other end. Of course, any conventional units for tie-up of the hood 22 may be adopted, for example, a string being independent of the pillar and the hood.

Figure 32:
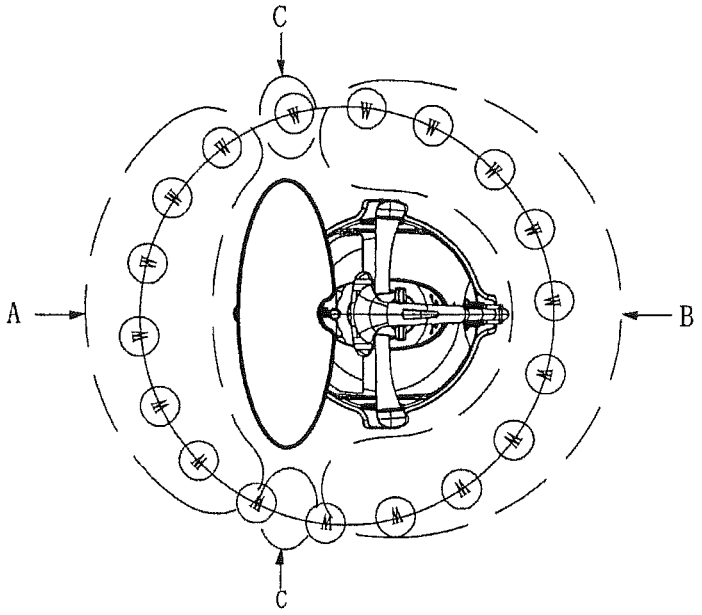
FIG. 32 is a working region distribution diagram of a drying-ironing combined machine according to the present invention.
Figure 33:
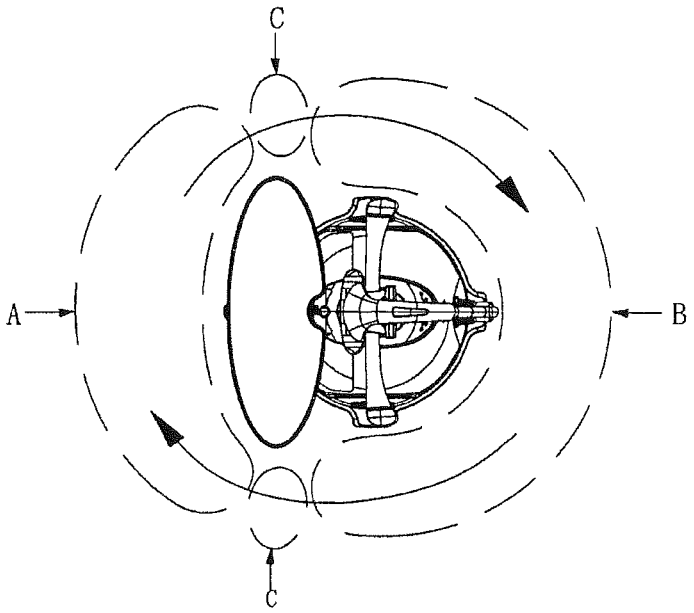
FIG. 33 is a working trace diagram of a drying-ironing combined machine according to the present invention.
Figure 34A:
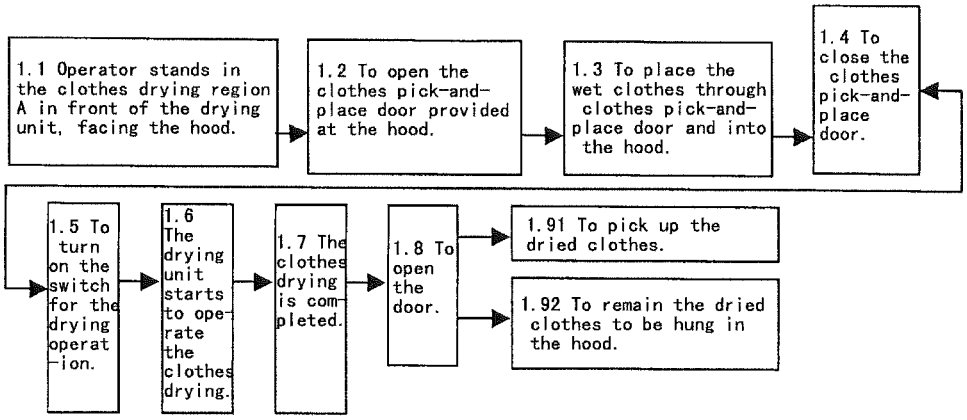
Figure 34B:
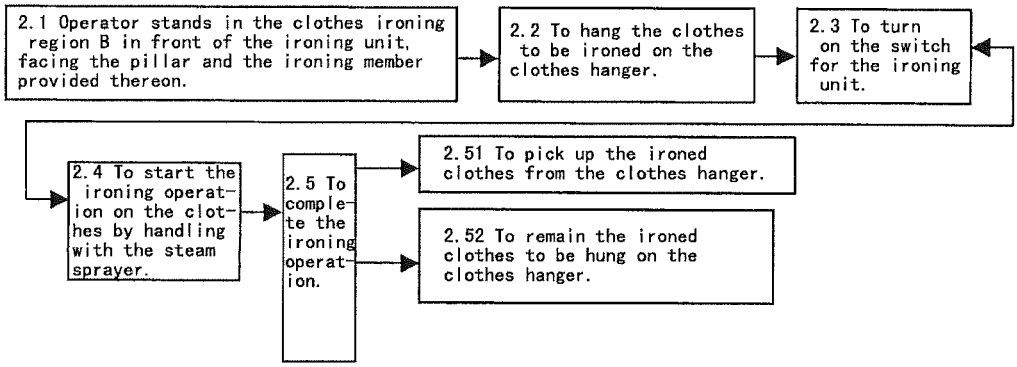
Figure 34C:
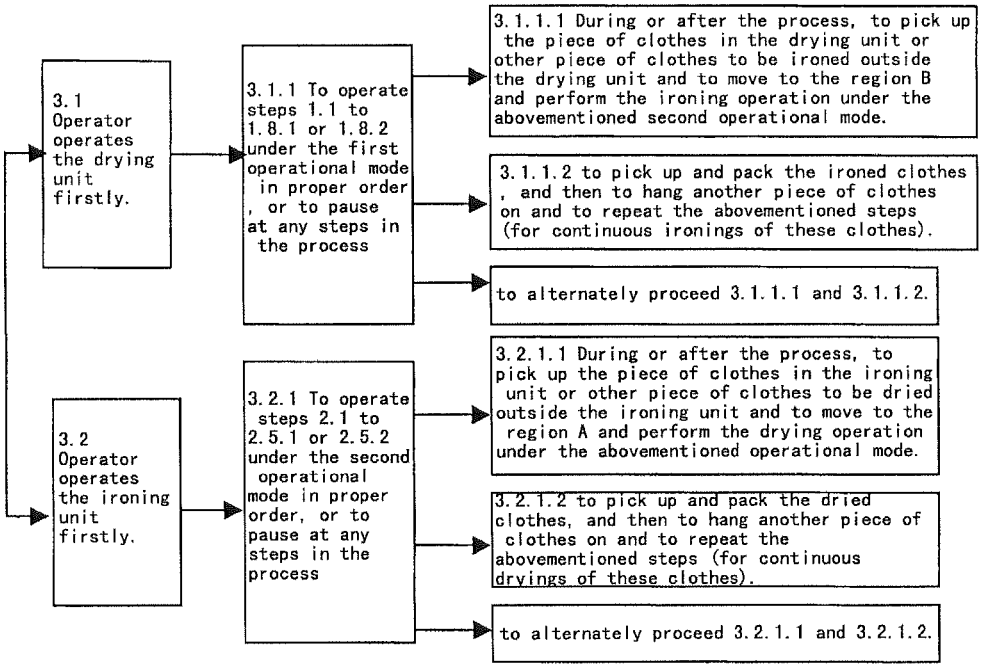
Figure 34D:
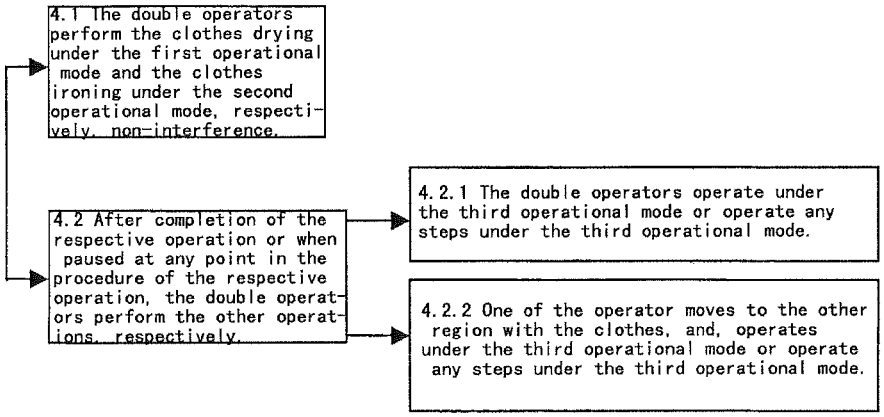
Figure 35:
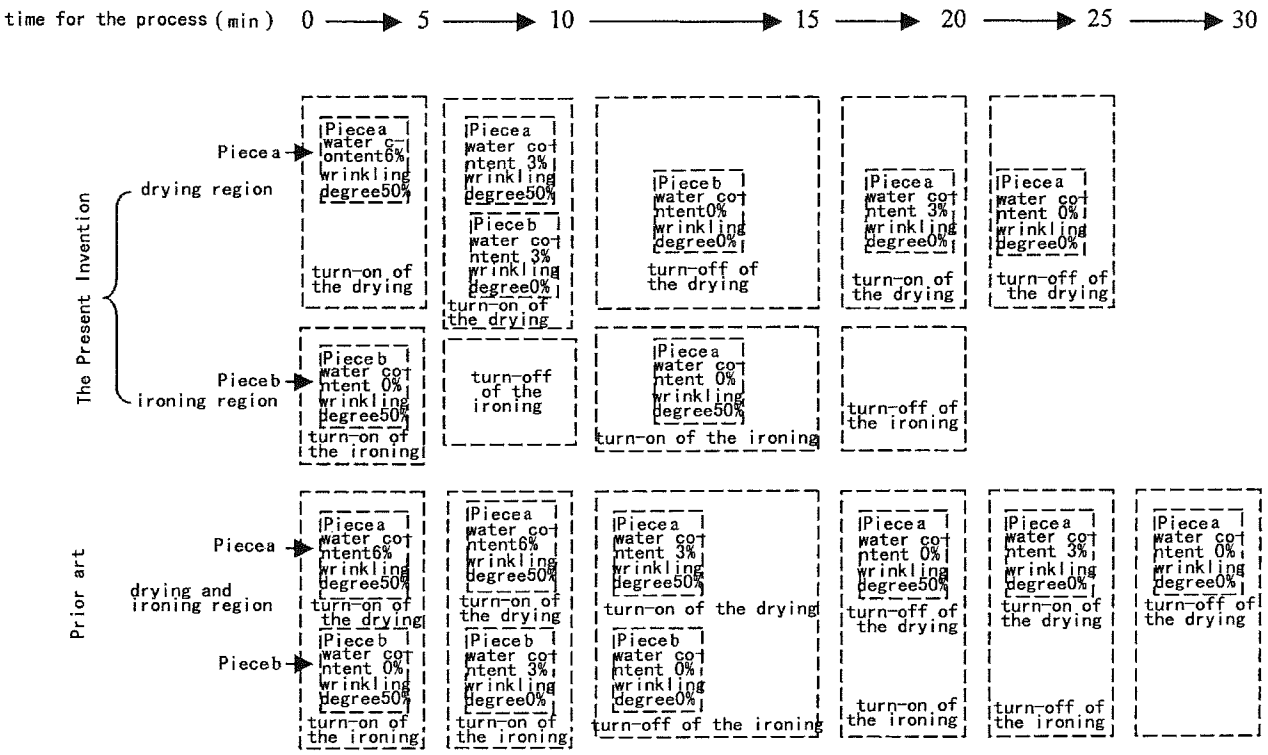
FIG. 35 is a comparison view between the drying and ironing procedures according to the present invention and those in the prior art.

As shown in FIGS. 32-35, FIG. 32 is a working region distribution diagram of a drying-ironing combined machine according to the present invention; FIG. 33 is a working trajectory diagram of a drying-ironing combined machine according to the present invention; FIG. 34 are flowchart diagrams for these operational mode, in which FIG. 34*a* is a flowchart diagram for a first operational mode, FIG. 34*b* is a flowchart diagram for a second operational mode, FIG. 34*c* is a flowchart diagram for a third operational mode, and, FIG. 34*d* is a flowchart diagram for a fourth operational mode; and, FIG. 35 is a comparison view between the drying and ironing procedures according to the present invention and those in the prior art. There are four operational modes for the drying-ironing combined machine according to the present invention as follows.

First Operational Mode

Clothes Drying Mode

As shown in FIG. 34*a*, it comprises the following steps.

1.1 Operator stands in the clothes drying region A in front of the drying unit, facing the hood 22.

1.2 To open the clothes pick-and-place door 224 provided at the front surface of the hood 22.

1.3 To place the wet clothes to be dried through clothes pick-and-place door 224 and into the accommodation space 223 of the hood 22.

1.4 To close the clothes pick-and-place door 224.

1.5 To turn on the drying switch and set a level of drying mode.

1.6 The drying unit 2 starts to operate the clothes drying under the drying mode.

1.7 The clothes drying is completed once time for this level of drying mode is up.

1.8 To open the clothes pick-and-place door 224.

1.91 To pick up the dried clothes 51; or 1.92 To keep the dried clothes 51 be hung within the accommodation space 223.

As shown in FIG. 32, operation of the drying unit under the first operational mode is completed in the clothes drying region A.

Second Operational Mode

Clothes Ironing Mode

As shown in FIG. 34*b*, it comprises the following steps.

2.1 Operator stands in the clothes ironing region B in front of the ironing unit, facing the ironing member 33 provided at the pillar 4.

2.2 To hang the clothes 51 to be ironed on the clothes hanger 331.

2.3 To turn on the control switch for the ironing unit.

2.4 To start an ironing operation on the clothes 51 by using the steam sprayer 32.

2.5 To complete the ironing operation.

2.61 To pick up the ironed clothes 51 from the clothes hanger 331, or 2.62 To keep the ironed clothes 51 be hung on the clothes hanger 331.

As shown in FIG. 32, operation of the ironing unit under the second operational mode can be completed in the clothes ironing region B.

Third Operational Mode—Simultaneous Clothes Ironing and Drying Mode by Single Operator As shown in FIG. 34*c*, it comprises the following steps.

3.1.1 Firstly, operator operates the clothes drying of the drying unit under the first operational mode.

3.1.2 After completion of the clothes drying or when paused at any point in the procedure of the clothes drying, to operate the clothes ironing of the ironing unit under the second operational mode, or to alternatively operate the clothes drying under the first operational mode or the clothes ironing under the second operational mode. Or, 3.2.1 Firstly, operator operates the clothes ironing of the ironing unit under the second operational mode.

3.2.2 After completion of the clothes ironing or when paused at any point in the procedure of the clothes ironing, to operate the clothes drying of the drying unit under the first operational mode, or to alternatively operate the clothes drying under the first operational mode or the clothes ironing under the second operational mode.

As shown in FIGS. 32 and 33, firstly, the operator W performs either of the clothes ironing operation within the clothes drying region A and the clothes drying operation within the clothes ironing region B, then, he/she moves to the other region via the transition region C and performs the other operation. For both the clothes ironing and the clothes drying operations, the working trajectory of the operator is one circle or a half circle around the machine. And, the total time for drying and ironing the same clothes is the sum of the time for drying the clothes and the time for ironing the clothes.

Further, the operator can perform simultaneously the clothes ironing operation and the clothes drying operation, for two or more pieces of clothes. As shown in FIG. 35, there are the ironing and drying operations on two pieces of clothes, in which, Piece a, water content 6%; wrinkling degree 50%; and, Piece b, water content 0%; wrinkling degree 50%. It should be noted that, time for drying each piece with water content 6% is ten mins, time for drying each piece with water content 3% is five mins, and, time for ironing each piece with wrinkling degree 50% is five mins. Further, during the clothes ironing operation, each piece has evaporation content 3% per five mins. The operations are completed when each piece has water content of 0% and wrinkling degree of 0%. For the machine according to the present invention, the clothes drying region where the drying operation is performed and the clothes ironing region where the ironing operation is performed are arranged in either side of the pillar 4, without interference between each other. Thus, the operator can start the drying operation on Piece a and the clothes ironing operation on Piece b simultaneously. After a five minutes, the clothes ironing operation in the ironing unit 3 finishes and here Piece b has evaporation content of 3% while Piece a has water content of 3% and wrinkling degree of 50%. Then, Piece b is delivered into the drying unit 2 and, together with Piece a, is performed under the clothes drying operation. After another five minutes, the clothes drying operation in the drying unit 2 finishes and here Piece b has water content of 0% and wrinkling degree of 0% while Piece a has water content of 0% and wrinkling degree of 50%. Next, Piece a is delivered into the ironing unit 3 and is performed under the clothes ironing operation. After another further five minutes, the clothes ironing operation in the ironing unit 3 finishes and here Piece a has water content of 3% and wrinkling degree of 0%. Again, the Piece a is delivered into the drying unit 2 and is performed under the clothes drying operation. After another yet five minutes, the clothes drying operation in the drying unit 2 finishes and here Piece a has water content of 0% and wrinkling degree of 0%. By use of the machine according to the present invention, all the operations are finished and the total time for drying and ironing the two pieces of clothes is twenty-five mins. In contrast, for conventional drying-ironing combined machine, the drying operation and the ironing operation are performed in the same region. Thus, the operator starts the original drying and ironing operations on Piece a and Piece b simultaneously. After a five minutes, Piece b has water content of 3% and wrinkling degree of 0% while Piece a has water content of 6% due to moisture from the steam vapor and wrinkling degree of 50%. Here, operation in the ironing unit stops, and, Piece b and Piece a together are performed under the clothes drying operation. After another five minutes, Piece b has water content of 0% and wrinkling degree of 0% and the operations on Piece b is finished, while Piece a has water content of 3% and wrinkling degree of 50%. Here, operation in the drying unit stops, and Piece a is performed under the clothes drying operation. After another still five minutes, here Piece a has water content of 3% and wrinkling degree of 0%. Again, operation in the ironing unit stops, and Piece a is performed under the clothes drying operation. After another yet five minutes, Piece a has water content of 0% and wrinkling degree of 0% and the operations on Piece b is finished. By use of the convention machine, all the operations are finished and the total time for drying and ironing the two pieces of clothes is thirty mins. Further, by use of the convention machine, the door of the hood has to be opened during the whole process, in order to allow the steam sprayer to get into the hood for perform the ironing operation on the clothes to be ironed. This accelerates dissipation of heat energy in the hood and causes slow rise in temperature within the hood, thereby prolonging the time required for clothes drying. However, assuming that there is no hood, more serious dissipation of heat energy will occur, thereby not only prolonging the time required for clothes drying but also resulting in great waste of energy. As a result of this comparison, the drying-ironing combined machine according to the present invention has a significantly shorter time for both the drying and the ironing simultaneously than that of the prior art, and thus, achieves higher efficient.

Fourth Operational Mode

Simultaneous Clothes Ironing and Drying Mode by Double Operators

As shown in FIG. 34*d*, it comprises the following steps.

4.1.1 The double operators operate the clothes drying of the drying unit under the first operational mode and the clothes ironing of the ironing unit under the second operational mode, respectively, without interference with each other, till the clothes drying under the first operational mode and the clothes ironing under the second operational mode are completed. Or, 4.2.1 The double operators operate the clothes drying of the drying unit under the first operational mode and the clothes ironing of the ironing unit under the second operational mode, respectively.

4.2.2 After completion of the respective operation or when paused at any point in the procedure of the respective operation, the double operators operate under the third operational mode, or, after completion of the respective operation or when paused at any point in the procedure of the respective operation, the double operators simultaneously operate the ironing unit under the first operational mode.

In the fourth operational mode where clothes ironing operation and clothes drying operation are performed simultaneously by double operators, the operators may perform the clothes ironing operation and the clothes drying operation in their respective regions, from beginning to end. As an alternative, the operators may perform firstly the clothes ironing operation and the clothes drying operation in their respective regions, and then, enter the other regions via the transition region C and perform the other operations. This alternation can be repeated at will. As another alternative, the operators may perform the clothes ironing operation and the clothes drying operation in their respective regions, and, after completion of the clothes ironing operation, the ironing man enters the clothes drying region A through the transition region C from the clothes ironing region B and performs the clothes drying operation, together with the drying man.

Further, as shown in Table 1, it presents comparison of the effects between these according to the present invention and those in the prior art references 3 and 4. As shown, the drying-ironing combined machine according to the present invention has the advantages such as smaller volume, multiple function, high efficiency for both clothes drying and clothes ironing, and, shortened operation time. Moreover, the machine according to the present invention is simple for use and saves energy.

Although several exemplary embodiments of the disclosure have been described hereinbefore, it would be understood by those skilled in the art that various changes or modifications may be made in these embodiments. Any changes, equivalents, and improvements may be made without departing from the principles and spirit of the disclosure, the scope of which is defined in the claims and their equivalents.

What is claimed is:

1. A drying-ironing combined machine, comprising a supporting body (1), and a pillar (4) uprightly located above the supporting body (1), a drying unit (2) and an ironing unit (3), wherein the drying unit (2) comprises a drying rack member (21) mounted on an upper end of the pillar (4) and located in a deploying manner at one side of the pillar (4), a hood (22) supported on the drying rack member (21) and located in a naturally hanging-down manner at one side of the pillar (4) to form an accommodation space (223), and a heating member (23) for supplying heated air into the accommodation space (223) of the hood (22), wherein, the hood (22) has an air inlet (225) and an air outlet (226) thereon, the heating member (23) has a venting port (232) being hermetically intercommunicated with the air inlet (225) of the hood (22), and, the drying unit (2) has a clothes drying region formed at one side of the pillar (4); and the ironing unit (3) comprises a clothes hanger (331) mounted on the upper end at the other side of the pillar (4), a steam generator (35) located within the supporting body (1), and, a steam outlet port (30) provided on a housing of the supporting body (1) and hermetically connected to the steam generator (35), wherein a steam hose (31) has one end connected to the steam outlet port (30) and the other end connected to a steam sprayer (32), and, the ironing unit (3) has a clothes ironing region formed at another side of the pillar (4), in which the pillar (4) includes a first extension arm (2133) provided at a top end thereof and protruding towards the drying unit (2), the first extension arm (2133) having a plurality of hookers (21331) thereon; and the hood (22) has an opening (227) at the top thereof and from which the clothes are hung onto the hooker (21331), the opening (227) serving as the air outlet (226).

2. A drying-ironing combined machine according to claim 1, wherein the heating member (23) is located within the supporting body (1), the housing of the supporting body (1) is provided with intake openings (231) and said venting ports (232) thereon, in the supporting body (1) is provided an air flow passageway (239) between the intake openings (231) and the venting ports (232), and the heating member (23) includes a fan (238) and a heating element (237) located in the air flow passageway (239).

3. The drying-ironing combined machine according to claim 2, wherein a chamber (26) is provided between the venting port (232) of the heating member (23) and the air inlet (225) at the bottom of the hood (22) and a top plate (263) of which is mated with the air inlet (225) of the hood (22), and wherein several venting holes (2631) which go through the hood (22) are provided on the top plate (263).

4. The drying-ironing combined machine according to claim 1, wherein a chamber (26) that is connected to the air inlet (225) of the hood (22) is provided between the hood (22) and the supporting body (1), wherein the chamber (26) is intercommunicated with intake holes (265, 265') and has a partition (264) by which the chamber (26) is divided into an upper buffer room (261) and a lower electrical appliances room (262) being intercommunicated with each other, and the heating member (23) is mounted on the partition (264).

5. The drying-ironing combined machine according to claim 4, wherein the intake holes (265) are located on a side wall of the chamber (26); or said chamber (26) is intercommunicated with the supporting body (1) and the intake holes (265') are located on the supporting body (1).

6. The drying-ironing combined machine according to claim 1, wherein the heating member (23) is mounted, on the pillar (4) above the drying rack member (21), on the middle part of the pillar (4) between the drying rack member (21) and the supporting body (1) or on a lower end of the pillar (4).

7. The drying-ironing combined machine according to claim 6, wherein, in the state that the heating member (23) is mounted on the pillar (4) that is above the drying rack member (21), within a housing of the heating member (23) is provided a partition (234) by which the housing of the heating member (23) is divided into an upper electrical appliances room (236) and a lower buffer room (235), a fan (238) and a heating element (237) of the heating member (23) are coaxially mounted on the partition (234) toward the electrical appliances room (236), at an upper end of the housing of the heating member (23) is provided the intake openings (231), and a plurality of venting holes (232') is distributed on a bottom plate (233) of the housing of the heating member and is in communication with an upper opening, i.e., the air inlet, of the hood (22).

8. The drying-ironing combined machine according to claim 6, wherein, in the state that the heating member (23) is mounted on a lower end of the pillar (4), a plurality of venting holes (232') is provided on a top plate (233') of the housing of the heating member (23) and is in communication with a lower opening, i.e., the air inlet, of the hood (22), at a bottom end of the housing of the heating member (23) is provided a plurality of intake openings (231), within a housing of the heating member (23) is provided a partition by which the housing is divided into a lower electrical appliances room (236) and an upper buffer room (235), a fan (238) and a heating element (237) of the heating member (23) are coaxially mounted on the partition (234) toward the electrical appliances room (236).

9. The drying-ironing combined machine according to claim 1, wherein the drying rack member (21) includes a top supporting frame (211) and a lateral buckle device (212) located on the top supporting frame (211), wherein an top end of the hood (22) is mounted on the top supporting frame (211) and is also mounted on the upper end of the pillar (4) by means of the lateral buckle device (212).

10. The drying-ironing combined machine according to claim 9, wherein the top supporting frame (211) is in an elliptic shape, and has an accommodation width (a) corresponding to a shoulder width of the tops and an accommodation thickness (b) corresponding to a chest and back thickness of the tops, and the lateral buckle device (212) is located in the middle along the direction of the accommodation width (a) of the top supporting frame.

11. The drying-ironing combined machine according to claim 9, wherein the drying rack member (21) comprises the top supporting frame (211) mounted in an annular recess (230) around the bottom of the housing of the heating member (23).

12. The drying-ironing combined machine according to claim 9, wherein the lateral buckle device (212) includes a hanger extending towards the hood (22).

13. The drying-ironing combined machine according to claim 1, wherein a bottom frame (24) or a bottom plate (25) is provided at the bottom of the hood (22) and is mounted on a lower end of the pillar (4) by a lateral buckle (6).

14. The drying-ironing combined machine according to claim 1, wherein the ironing unit (3) further includes a retaining shelf (332) adapted for holding of the steam sprayer (32) and located at an upper part of the clothes hanger (331).

15. The drying-ironing combined machine according to claim 1, wherein the pillar (4) includes first and second supporting rods (**4*a*1, 4*a*2) horizontally spaced by a distance and being parallel to each other so as to be arranged in a "||" configuration, and the drying rack member (21) is located on the second supporting rod (4*a*2) and the clothes hanger (331) is located on the first supporting rod (4*a*1**).

16. The drying-ironing combined machine according to claim 1, wherein the pillar includes first and second supporting rods (**4*b*1, 4*b*2) which have upper parts thereof horizontally spaced by a distance and lower parts combined together so as to be arranged in a substantially "Y" configuration, and, the drying rack member (21) is located on the second supporting rod (4*b*2) and the clothes hanger (331) is located on the first supporting rod (4*b*1**).

17. The drying-ironing combined machine according to claim 1, wherein the pillar (4) includes first and second supporting rods (**4*c*1, 4*c*2) which have lower parts thereof horizontally spaced by a distance and upper parts connected with each other so as to be arranged in substantially an "n" configuration, and the drying rack member (21) is located on the second supporting rod (4*c*2) and the clothes hanger (331) is located on the first supporting rod (4*c*1**).

18. The drying-ironing combined machine according to claim 1, wherein the hood (22), on the back surface (221) thereof, has a lower perforated hole (228') and an upper perforated hole (228) through which certain section (43) of the pillar passes, and the certain section (43) of the pillar (4) is located inside the hood (22).

19. The drying-ironing combined machine according to 18, wherein the certain section (43) of the pillar (4) inside the hood (22) is provided with at least one hanger (2131).

20. The drying-ironing combined machine according to 1, wherein the pillar comprises a second extension arm (331) provided at the top end thereof and protruding towards the ironing unit (3) and being integrated with the first extension arm (2133), and wherein the second extension arm (331) also has a plurality of hookers (3311) thereon.

21. The drying-ironing combined machine according to 1, wherein the hood (22) has a stretching mechanism (2210) at the top thereof, the stretching mechanism (2210) including a clothes hanging arrangement (2210*a*) for hanging of the hood (22) on the first extension arm (2133) and a discoid arrangement (2210*b*) for the stretching of an upper end of the hood (22).

22. The drying-ironing combined machine according to claim 1, wherein the hood (22), on the back surface (221) thereof, has fastening mechanism (8) by which the hood is fastened onto the pillar (4).

23. The drying-ironing combined machine according to claim 1, further comprising a binding member (45) for gathering and fastening the hood (22) onto the pillar.

24. A drying-ironing combined machine, comprising a supporting body (1), and a pillar (4) uprightly located above the supporting body (1), a drying unit (2) and an ironing unit (3), wherein the drying unit (2) is located at one side of the pillar (4), the drying unit (2) comprises a drying rack member (21) located on an upper end, and at one side, of the pillar (4), a hood (22) supported on the drying rack member (21) and located in a naturally hanging-down manner along the pillar (4), and a heating member (23) for supplying heated air into an accommodation space (223) of the hood (22), wherein the hood (22) has an air outlet (226) and an air inlet (225) thereon, the heating member (23) comprises a venting port (232) deviated from the pillar (4) and hermetically connected to the air inlet (225) of the hood (22); and the ironing unit (3) is located at the other side of the pillar (4), the ironing unit (3) comprises a clothes hanger (331) mounted on the upper end at the other side, of the pillar (4), a steam generator (35) located within the supporting body (1), a steam outlet port (30) provided on a housing of the supporting body (1) which is located at the other side of the pillar (4), and hermetically connected to the steam generator (35), wherein a steam hose (31) has one end connected to the steam outlet port (30) and the other end connected to a steam sprayer (32), in which the pillar (4) includes a first extension arm (2133) provided at a top end thereof and protruding towards the drying unit (2), the first extension arm (2133) having a plurality of hookers (21331) thereon; and the hood (22) has an opening (227) at the top thereof and from which the clothes are hung onto the hooker (21331), the opening (227) serving as the air outlet (226).

25. A drying-ironing combined machine according to claim 24, wherein the heating member (23) is located within the supporting body (1), the housing of the supporting body (1) is provided with intake openings (231) and said venting ports (232) thereon, in the supporting body (1) is provided an air flow passageway (239) between the intake openings (231) and the venting ports (232), and the heating member (23) includes a fan (238) and a heating element (237) located in the air flow passageway (239).

26. The drying-ironing combined machine according to claim 25, wherein a chamber (26) is provided between the venting port (232) of the heating member (23) and the air inlet (225) at the bottom of the hood (22) and a top plate (263) of which is mated with the air inlet (225) of the hood (22), and wherein several venting holes (2631) which go through the hood (22) are provided on the top plate (263).

27. The drying-ironing combined machine according to claim 24, wherein a chamber (26) that is connected to the air inlet (225) of the hood (22) is provided between the hood (22) and the supporting body (1), the chamber (26) being intercommunicated with intake holes (265, 265') and having a partition (264) by which the chamber (26) is divided into an upper buffer room (261) and a lower electrical appliances room (262) being intercommunicated with each other, and the heating member (23) is mounted on the partition (264).

28. The drying-ironing combined machine according to claim 27, wherein the intake holes (265) are located on a side wall of the chamber (26); or said chamber (26) is intercommunicated with the supporting body (1), and the intake holes (265') are located on the supporting body (1).

29. The drying-ironing combined machine according to claim 24, wherein the heating member (23) is mounted, on the pillar (4) above the drying rack member (21), on the middle part of the pillar (4) between the drying rack member (21) and the supporting body (1), or on a lower end of the pillar (4).

30. The drying-ironing combined machine according to claim 29, wherein, in the state that the heating member (23) is mounted on the pillar (4) that is above the drying rack member (21), within a housing of the heating member (23) is provided a partition (234) by which the housing of the heating member (23) is divided into an upper electrical appliances room (236) and a lower buffer room (235), a fan (238) and a heating element (237) of the heating member (23) are coaxially mounted on the partition (234) toward the electrical appliances room (236), at an upper end of the housing of the heating member (23) is provided the intake openings (231), and a plurality of venting holes (232') is distributed on a bottom plate (233) of the housing of the heating member and is in communication with an upper opening, i.e., the air inlet, of the hood (22).

31. The drying-ironing combined machine according to claim 29, wherein, in the state that the heating member (23) is mounted on a lower end of the pillar (4), a plurality of venting holes (232') is provided on a top plate (233') of the housing of the heating member (23) and is in communication with a lower opening, i.e., the air inlet, of the hood (22), at a bottom end of the housing of the heating member (23) is provided a plurality of intake openings (231), within a housing of the heating member (23) is provided a partition by which the housing is divided into a lower electrical appliances room (236) and an upper buffer room (235), a fan (238) and a heating element (237) of the heating member (23) are coaxially mounted on the partition (234) toward the electrical appliances room (236).

32. The drying-ironing combined machine according to claim 24, wherein the drying rack member (21) includes a top supporting frame (211) and a lateral buckle device (212) located on the top supporting frame (211), and wherein a top end of the hood (22) is mounted on the top supporting frame (211) and is also mounted on the top end of the pillar (4) by means of the lateral buckle device (212).

33. The drying-ironing combined machine according to claim 32, wherein the top supporting frame (211) is in an elliptic shape and has an accommodation width (a) corresponding to a shoulder width of the tops and an accommodation thickness (b) corresponding to a chest and back thickness of the tops, and the lateral buckle device (212) is located in the middle along the direction of the accommodation width (a) of the top supporting frame.

34. The drying-ironing combined machine according to claim 32, wherein the drying rack member (21) comprises the top supporting frame (211) mounted in an annular recess (230) around the bottom of the housing of the heating member (23).

35. The drying-ironing combined machine according to claim 32, wherein the lateral buckle device (212) includes a hanger extending towards the hood (22).

36. The drying-ironing combined machine according to claim 24, wherein a bottom frame (24) or a bottom plate (25) is provided at the bottom of the hood (22) and is mounted on a lower end of the pillar by a lateral buckle (6).

37. The drying-ironing combined machine according to claim 24, wherein the ironing unit (3) further includes a retaining shelf (332) adapted for holding of the steam sprayer (32) and located at an upper part of the clothes hanger (331).

38. The drying-ironing combined machine according to claim 24, wherein the pillar (4) includes first and second supporting rods (**4*a*1, 4*a*2) horizontally spaced by a distance and being parallel to each other so as to be arranged in a "||" configuration, and the drying rack member (21) is located on the second supporting rod (4*a*2) and the clothes hanger (331) is located on the first supporting rod (4*a*1**).

39. The drying-ironing combined machine according to claim 24, wherein the pillar (4) first and second supporting rods (**4*b*1, 4*b*2) which have upper parts thereof horizontally spaced by a distance and lower parts combined together so as to be arranged in a substantially "Y" configuration, and the drying rack member (21) is located on the second supporting rod (4*b*2) and the clothes hanger (331) is located on the first supporting rod (4*b*1**).

40. The drying-ironing combined machine according to claim 24, wherein the pillar (4) includes first and second supporting rods (**4*c*1, 4*c*2) which have lower parts thereof horizontally spaced by a distance and upper parts connected with each other so as to be arranged in substantially a "n" configuration, and, the drying rack member (21) is located on the second supporting rod (4*c*2) and the clothes hanger (331) is located on the first supporting rod (4*c*1**).

41. The drying-ironing combined machine according to claim 24, wherein the hood (22), on the back surface (221) thereof, has a lower perforated hole (228') and an upper perforated hole (228) through which certain section (43) of the pillar passes, and the certain section (43) of the pillar (4) is located inside the hood (22).

42. The drying-ironing combined machine according to 41, wherein the certain section (43) of the pillar (4) inside the hood (22) is provided with at least one hanger (2131).

43. The drying-ironing combined machine according to 24, wherein the pillar (4) includes a second extension arm (331) provided at the top end thereof and protruding towards the ironing unit (3) and being integrated with the first extension arm (2133), the second extension arm (331) also having a plurality of hookers (3311) thereon.

44. The drying-ironing combined machine according to 24, wherein the hood (22) has a stretching mechanism (2210) at the top thereof, and wherein the stretching mechanism (2210) includes a clothes hanging arrangement (**2210*a*) for hanging of the hood (22) on the first extension arm (2133) and a discoid arrangement (2210*b*) for the stretching of an upper end of the hood (22**).

45. The drying-ironing combined machine according to claim 24, wherein the hood (22), on the back surface (221) thereof, has a fastening mechanism (8) by which the hood is fastened onto the pillar.

46. The drying-ironing combined machine according to claim 24, further comprising a binding member (45) for gathering and fastening the hood (22) onto the pillar.

* * * * *